US011738897B2

(12) United States Patent
Pettersson

(10) Patent No.: US 11,738,897 B2
(45) Date of Patent: Aug. 29, 2023

(54) BOX ERECTING METHOD AND SYSTEM

(71) Applicant: PACKSIZE LLC, Salt Lake City, UT (US)

(72) Inventor: Niklas Pettersson, Västerås (SE)

(73) Assignee: Packsize LLC, Salt Lake City, UT (US)

( * ) Notice: Subject to any disclaimer, the term of this patent is extended or adjusted under 35 U.S.C. 154(b) by 0 days.

(21) Appl. No.: 17/586,517

(22) Filed: Jan. 27, 2022

(65) Prior Publication Data

US 2022/0144469 A1 May 12, 2022

Related U.S. Application Data

(62) Division of application No. 16/491,088, filed as application No. PCT/US2018/020928 on Mar. 5, 2018, now Pat. No. 11,286,073.

(30) Foreign Application Priority Data

Mar. 6, 2017 (SE) ..... 1750247-7

(51) Int. Cl.

| | |
|---|---|
| ***B65B 43/26*** | (2006.01) |
| ***B31B 50/00*** | (2017.01) |
| ***B31B 50/26*** | (2017.01) |
| ***B31B 50/36*** | (2017.01) |
| ***B31B 50/62*** | (2017.01) |

(Continued)

(52) U.S. Cl.

CPC ..... *B65B 43/265* (2013.01); *B31B 50/004* (2017.08); *B31B 50/006* (2017.08); *B31B 50/262* (2017.08); *B31B 50/36* (2017.08); *B31B 50/624* (2017.08); *B65B 11/004* (2013.01); *B65B 59/003* (2019.05);

(Continued)

(58) Field of Classification Search

CPC ..... B31B 50/004; B31B 50/006; B31B 50/34; B31B 50/36; B31B 50/262; B31B 2110/35; B31B 2120/302; B65B 11/004; B65B 2210/04; B65B 43/265; B65B 59/003

See application file for complete search history.

(56) References Cited

U.S. PATENT DOCUMENTS

| | | | |
|---|---|---|---|
| 1,809,853 | A | 6/1931 | Knowlton |
| 2,077,428 | A | 4/1937 | Mabon |

(Continued)

FOREIGN PATENT DOCUMENTS

| | | | |
|---|---|---|---|
| CN | 2164350 | Y | 5/1994 |
| CN | 1191833 | A | 9/1998 |

(Continued)

OTHER PUBLICATIONS

Office Action received for U.S. Appl. No. 14/970,224, dated May 30, 2018.

(Continued)

*Primary Examiner* — Andrew M Tecco
*Assistant Examiner* — Nicholas E Igbokwe
(74) *Attorney, Agent, or Firm* — Workman Nydegger

(57) ABSTRACT

A method and a system for erecting boxes from box templates of different sizes, said method comprising the steps of:

adjusting a size of a frame according to a size of a box template which should be erected;

wrapping the box template to be erected around the frame; and separating the frame from the box template.

20 Claims, 15 Drawing Sheets

(51) Int. Cl.

| | |
|---|---|
| ***B65B 11/00*** | (2006.01) |
| ***B65B 59/00*** | (2006.01) |
| *B31B 120/30* | (2017.01) |
| *B31B 110/35* | (2017.01) |

(52) U.S. Cl.

CPC ..... *B31B 2110/35* (2017.08); *B31B 2120/302* (2017.08); *B65B 2210/04* (2013.01)

(56) References Cited

U.S. PATENT DOCUMENTS 2,083,351 A 6/1937 Sidebotham
2,181,117 A 11/1939 Brenn
2,217,784 A 10/1940 Bennett et al.
2,256,082 A 9/1941 Feurt
2,353,419 A 7/1944 Smithson
2,449,663 A 9/1948 Marcalus
2,609,736 A 9/1952 Montgomery
2,631,509 A 3/1953 Whytlaw
2,679,195 A 5/1954 Whytlaw
2,699,711 A 1/1955 Mobley
2,798,582 A 7/1957 Monroe et al.
2,887,021 A 5/1959 Duffy et al.
2,904,789 A 9/1959 Arthur et al.
2,989,903 A 6/1961 Wilcox
3,057,267 A 10/1962 Johnson, Jr.
3,096,692 A 7/1963 Crathern et al.
3,105,419 A 10/1963 La Bombard
3,108,515 A 10/1963 Stohlquist
3,119,547 A 1/1964 Nute
3,153,991 A 10/1964 Goodrich
3,242,827 A 3/1966 Winters
3,285,145 A 11/1966 Lieberman
3,288,349 A 11/1966 Palmer et al.
3,299,611 A 1/1967 Hendrick et al.
3,303,759 A 2/1967 Burke
3,308,723 A 3/1967 Bergh, Jr.
3,326,096 A 6/1967 Mendoza
3,406,611 A 10/1968 Benjamin et al.
3,418,893 A 12/1968 Stohlquist et al.
3,451,318 A 6/1969 Arnaudon et al.
3,469,508 A 9/1969 Heinz
3,476,023 A 11/1969 Fuller et al.
3,511,496 A 5/1970 Zoglmann
3,566,755 A 3/1971 Smith et al.
3,584,434 A 6/1971 Ellis
3,611,884 A 10/1971 Hottendorf
3,618,479 A 11/1971 Shields
3,628,408 A 12/1971 Rod
3,646,418 A 2/1972 Sterns et al.
3,728,945 A 4/1973 Vuilleumier
3,743,154 A 7/1973 Brewitz
3,748,972 A 7/1973 Barton
3,763,750 A 10/1973 Reichert
3,776,109 A 12/1973 Clark et al.
3,803,798 A 4/1974 Clancy
3,804,514 A 4/1974 Jasinski
3,807,726 A 4/1974 Hope et al.
3,882,764 A 5/1975 Johnson
3,891,203 A 6/1975 Schiff
3,912,389 A 10/1975 Miyamoto
3,913,464 A 10/1975 Flaum
3,949,654 A 4/1976 Stehlin
4,033,217 A 7/1977 Flaum et al.
4,044,658 A 8/1977 Mitchard
4,052,048 A 10/1977 Shirasaka
4,056,025 A 11/1977 Rubel
4,094,451 A 6/1978 Wescoat
4,121,506 A 10/1978 Van Grouw
4,123,966 A 11/1978 Buschor
4,163,414 A 8/1979 Bachman et al.
4,164,171 A 8/1979 Gorshe et al.
4,173,106 A 11/1979 Garcia et al.
4,184,770 A 1/1980 Pinior
4,191,467 A 3/1980 Schieck
4,221,373 A 9/1980 Muller Hans
4,224,847 A 9/1980 Tokuno
4,261,239 A 4/1981 Toboshi et al.
4,264,200 A 4/1981 Tickner et al.
4,275,543 A * 6/1981 Marchetti ..... B65B 7/20 493/183
4,295,841 A 10/1981 Ward, Jr.
4,320,960 A 3/1982 Ward et al.
4,351,461 A 9/1982 Carlsson
4,368,052 A 1/1983 Bitsky et al.
4,373,412 A 2/1983 Gerber et al.
4,375,970 A 3/1983 Murphy et al.
4,401,250 A 8/1983 Carlsson
4,414,789 A 11/1983 Pattarozzi
4,437,570 A 3/1984 Sorenson
4,449,349 A 5/1984 Roth
4,487,596 A 12/1984 Livens et al.
4,563,169 A 1/1986 Virta et al.
4,578,054 A * 3/1986 Herrin ..... B31B 50/00 493/126
D286,044 S 10/1986 Kando
4,623,072 A 11/1986 Lorenz
4,638,696 A 1/1987 Urwyler
4,662,150 A * 5/1987 Johnson ..... B65B 43/265 493/313
4,695,006 A 9/1987 Pool
4,714,946 A 12/1987 Bajgert et al.
4,743,131 A 5/1988 Atwell
4,749,295 A 6/1988 Bankier et al.
4,773,781 A 9/1988 Bankier
4,838,468 A 6/1989 Lesse
4,844,316 A 7/1989 Keeny
4,847,632 A 7/1989 Norris
4,854,929 A 8/1989 Szuba
4,878,521 A 11/1989 Fredrickson
4,887,412 A 12/1989 Takamura
4,923,188 A 5/1990 Neir
4,932,930 A 6/1990 Coalier et al.
4,979,932 A 12/1990 Burnside
5,005,816 A 4/1991 Stemmler et al.
5,030,192 A 7/1991 Sager
5,039,242 A 8/1991 Johnson
5,046,716 A 9/1991 Lippold
5,058,872 A 10/1991 Gladow
5,072,641 A 12/1991 Urban et al.
5,074,836 A 12/1991 Fechner et al.
5,081,487 A 1/1992 Hoyer et al.
5,090,281 A 2/1992 Paulson et al.
5,094,660 A 3/1992 Okuzawa
5,105,600 A * 4/1992 DePoint, Jr. ..... B65B 5/024 53/157
5,106,359 A 4/1992 Lott
5,111,252 A 5/1992 Hamada et al.
5,118,093 A 6/1992 Makiura et al.
5,120,279 A 6/1992 Rabe
5,120,292 A * 6/1992 Ueda ..... B31B 50/00 493/124
5,120,297 A 6/1992 Adami
5,123,890 A 6/1992 Green, Jr.
5,123,894 A 6/1992 Bergeman et al.
5,137,172 A 8/1992 Wagner et al.
5,137,174 A 8/1992 Bell
5,197,366 A 3/1993 Paulson et al.
5,240,243 A 8/1993 Gompertz et al.
5,241,353 A 8/1993 Maeshima et al.
5,263,785 A 11/1993 Negoro et al.
D344,751 S 3/1994 Keong
5,305,993 A 4/1994 Staeb
5,321,464 A 6/1994 Jessen et al.
5,335,777 A 8/1994 Murphy et al.
5,352,178 A 10/1994 Pazdernik
5,358,345 A 10/1994 Damitio
5,369,939 A 12/1994 Moen et al.
5,375,390 A 12/1994 Frigo et al.
5,393,291 A 2/1995 Wingerter
5,411,252 A 5/1995 Lowell
5,584,633 A 12/1996 Scharer
5,586,758 A 12/1996 Kimura et al.
5,624,369 A 4/1997 Bidlack et al.

(56) References Cited

U.S. PATENT DOCUMENTS 5,671,593 A 9/1997 Ginestra et al.
5,716,313 A 2/1998 Sigrist et al.
5,727,725 A 3/1998 Paskvich
5,767,975 A 6/1998 Ahlen
5,836,498 A 11/1998 Turek
5,902,223 A 5/1999 Simmons
5,927,702 A 7/1999 Ishii et al.
5,941,451 A 8/1999 Dexter
5,964,686 A 10/1999 Bidlack et al.
6,000,525 A 12/1999 Frulio
6,071,223 A 6/2000 Reider et al.
6,164,045 A 12/2000 Focke et al.
6,189,933 B1 2/2001 Felderman
6,321,650 B1 11/2001 Ogawa et al.
6,397,557 B1 6/2002 Bassissi et al.
6,428,000 B1 8/2002 Hara
6,471,154 B2 10/2002 Toth
6,553,207 B2 4/2003 Tsusaka et al.
6,568,865 B1 5/2003 Fujioka et al.
6,673,001 B2 1/2004 Toth
6,690,476 B1 2/2004 Hren
6,830,328 B2 12/2004 Cuyler, Jr.
6,837,135 B2 1/2005 Michalski
6,840,898 B2 1/2005 Pettersson
6,910,997 B1 6/2005 Yampolsky et al.
6,913,568 B2 7/2005 Frank et al.
6,968,859 B1 11/2005 Nagano et al.
7,100,811 B2 9/2006 Pettersson et al.
7,115,086 B1 10/2006 Campbell, Jr.
7,121,543 B2 10/2006 Fujioka
7,201,089 B2 4/2007 Richter
7,237,969 B2 7/2007 Bartman
7,390,291 B2 6/2008 Chiu Chen
7,537,557 B2 5/2009 Holler
7,637,857 B2 12/2009 Coullery et al.
7,641,190 B2 1/2010 Hara et al.
7,647,752 B2 1/2010 Magnell
7,648,451 B2 1/2010 Calugi
7,648,596 B2 1/2010 Sharpe et al.
7,690,099 B2 4/2010 Bapst et al.
7,997,578 B2 8/2011 Saito et al.
8,277,367 B2 10/2012 Jannin et al.
D703,246 S 4/2014 Pettersson et al.
8,999,108 B2 4/2015 Nagao et al.
9,069,151 B2 6/2015 Conner
9,120,284 B2 9/2015 Capoia
9,199,794 B2 12/2015 Nadachi et al.
9,227,373 B2 1/2016 Pettersson et al.
9,329,565 B2 5/2016 Osaki
9,352,526 B2 5/2016 Pettersson
9,924,502 B2 3/2018 Choi et al.
9,969,142 B2 5/2018 Pettersson et al.
10,093,438 B2 10/2018 Pettersson
10,286,621 B2 5/2019 Toro
2002/0017754 A1 2/2002 Kang
2002/0066683 A1 6/2002 Sanders
2002/0091050 A1 7/2002 Bacciottini et al.
2002/0115548 A1 8/2002 Lin et al.
2002/0125712 A1 9/2002 Felderman
2002/0139890 A1 10/2002 Toth
2003/0102244 A1 6/2003 Sanders
2003/0217628 A1 11/2003 Michalski
2004/0060264 A1 4/2004 Miller
2004/0082453 A1 4/2004 Pettersson
2004/0092374 A1 5/2004 Cheng
2004/0144555 A1 7/2004 Buekers
2004/0198577 A1 10/2004 Blumle
2004/0261365 A1 12/2004 White
2005/0079965 A1 4/2005 Moshier et al.
2005/0103923 A1 5/2005 Pettersson et al.
2005/0215409 A1 9/2005 Abramson et al.
2005/0280202 A1 12/2005 Vila et al.
2006/0100079 A1* 5/2006 Graham ..... B31B 50/00 493/71
2006/0178248 A1 8/2006 Coullery et al.
2006/0180438 A1 8/2006 Mosli et al.
2006/0180991 A1 8/2006 Nakahata et al.
2006/0181008 A1 8/2006 Van et al.
2007/0079575 A1 4/2007 Monti
2007/0228119 A1 10/2007 Barner
2007/0287623 A1 12/2007 Carlson et al.
2007/0289253 A1 12/2007 Miller
2008/0020916 A1 1/2008 Magnell
2008/0037273 A1 2/2008 Muehlemann et al.
2008/0066632 A1 3/2008 Raueiser
2008/0115641 A1 5/2008 Freyburger et al.
2008/0148917 A1 6/2008 Pettersson
2008/0300120 A1 12/2008 Sato
2009/0062098 A1 3/2009 Inoue et al.
2009/0178528 A1 7/2009 Adami
2009/0199527 A1 8/2009 Wehr et al.
2010/0041534 A1 2/2010 Harding et al.
2010/0111584 A1 5/2010 Shiohara et al.
2010/0206582 A1 8/2010 Meyyappan et al.
2010/0210439 A1 8/2010 Goto
2010/0263333 A1 10/2010 Langen
2011/0026999 A1 2/2011 Kohira
2011/0092351 A1 4/2011 Hatano et al.
2011/0099782 A1 5/2011 Schonberger et al.
2011/0110749 A1 5/2011 Carter et al.
2011/0171002 A1 7/2011 Pettersson
2011/0229191 A1 9/2011 Nomi
2011/0230325 A1 9/2011 Harding et al.
2011/0319242 A1 12/2011 Pettersson
2012/0021884 A1 1/2012 Musha
2012/0028776 A1 2/2012 Pettersson et al.
2012/0100976 A1* 4/2012 Graham ..... B31B 50/00 493/52
2012/0106963 A1 5/2012 Huang et al.
2012/0122640 A1 5/2012 Pazdernik et al.
2012/0122646 A1 5/2012 Murano
2012/0129670 A1 5/2012 Pettersson et al.
2012/0131888 A1* 5/2012 Pettersson ..... B65B 5/026 53/492
2012/0139670 A1 6/2012 Yamagata et al.
2012/0142512 A1 6/2012 Keller
2012/0242512 A1 9/2012 Horstemeyer
2012/0319920 A1 12/2012 Athley et al.
2012/0328253 A1 12/2012 Hurley et al.
2013/0000252 A1 1/2013 Pettersson et al.
2013/0045847 A1 2/2013 Capoia
2013/0104718 A1 5/2013 Tai
2013/0108227 A1 5/2013 Conner
2013/0130877 A1 5/2013 Su
2013/0146355 A1 6/2013 Strasser et al.
2013/0210597 A1 8/2013 Pettersson
2013/0294735 A1 11/2013 Burris et al.
2013/0333538 A1 12/2013 Long et al.
2014/0078635 A1 3/2014 Conner et al.
2014/0091511 A1 4/2014 Martin
2014/0101929 A1 4/2014 Kim et al.
2014/0140671 A1 5/2014 Islam
2014/0315701 A1 10/2014 Pettersson
2014/0336026 A1 11/2014 Pettersson
2014/0357463 A1 12/2014 Kojima
2015/0018189 A1 1/2015 Pettersson et al.
2015/0019387 A1 1/2015 Pettersson et al.
2015/0053349 A1 2/2015 Mori et al.
2015/0055926 A1 2/2015 Strasser et al.
2015/0103923 A1 4/2015 Ramasubramonian et al.
2015/0143777 A1* 5/2015 Rapp ..... B65B 43/39 53/131.4
2015/0148210 A1 5/2015 Sibthorpe
2015/0155697 A1 6/2015 Loveless et al.
2015/0224731 A1 8/2015 Ponti
2015/0273897 A1 10/2015 Kato et al.
2015/0355429 A1 12/2015 Villegas et al.
2015/0360433 A1 12/2015 Feijen et al.
2015/0360801 A1 12/2015 Sytema
2016/0001441 A1 1/2016 Osterhout et al.
2016/0049782 A1 2/2016 Strasser et al.
2016/0122044 A1 5/2016 Evers et al.
2016/0184142 A1 6/2016 Vanvalkenburgh et al.
2016/0185475 A1 6/2016 Pettersson

(56) References Cited

U.S. PATENT DOCUMENTS

| | | | |
|---|---|---|---|
| 2016/0241468 | A1 | 8/2016 | Sabella et al. |
| 2016/0340067 | A1 | 11/2016 | Winkler et al. |
| 2017/0080666 | A1 | 3/2017 | Graham et al. |
| 2017/0355166 | A1 | 12/2017 | Jonker |
| 2017/0361560 | A1 | 12/2017 | Ryan |
| 2018/0178476 | A1 | 6/2018 | Pettersson et al. |
| 2018/0201465 | A1 | 7/2018 | Osterhout |
| 2018/0265228 | A1 | 9/2018 | Hagestedt et al. |
| 2019/0002137 | A1 | 1/2019 | Pettersson |
| 2019/0184670 | A1 | 6/2019 | Davies et al. |
| 2019/0308383 | A1 | 10/2019 | Provoost et al. |
| 2019/0308761 | A1 | 10/2019 | Provoost et al. |
| 2019/0329513 | A1 | 10/2019 | Pettersson et al. |
| 2019/0389611 | A1 | 12/2019 | Pettersson |
| 2021/0001583 | A1 | 1/2021 | Osterhout |
| 2021/0283878 | A1 | 9/2021 | Pettersson et al. |
| 2022/0032570 | A1 | 2/2022 | Davies et al. |
| 2022/0080691 | A1 | 3/2022 | Osterhout et al. |

FOREIGN PATENT DOCUMENTS

| | | | | |
|---|---|---|---|---|
| CN | 1366487 | A | 8/2002 | |
| CN | 1876361 | A | 12/2006 | |
| CN | 102371705 | A | 3/2012 | |
| CN | 202412794 | U | 9/2012 | |
| CN | 102753442 | A | 10/2012 | |
| CN | 102941592 | A | 2/2013 | |
| CN | 104169073 | A | 11/2014 | |
| CN | 104185538 | A | 12/2014 | |
| CN | 104718067 | A | 6/2015 | |
| CN | 104812560 | A | 7/2015 | |
| CN | 204773785 | U | 11/2015 | |
| CN | 106079570 | A | 11/2016 | |
| DE | 1082227 | B | 5/1960 | |
| DE | 1212854 | B | 3/1966 | |
| DE | 2700004 | A1 | 7/1978 | |
| DE | 3343523 | A1 | 6/1985 | |
| DE | 3825506 | A1 | 2/1990 | |
| DE | 19541061 | C1 | 11/1996 | |
| DE | 10355544 | A1 | 6/2005 | |
| DE | 102005063193 | A1 | 7/2007 | |
| DE | 102008035278 | A1 | 2/2010 | |
| EA | 013852 | B1 | 8/2010 | |
| EP | 0030366 | A1 | 6/1981 | |
| EP | 0202998 | A1 | 11/1986 | |
| EP | 0234228 | A2 | 9/1987 | |
| EP | 0359005 | A1 | 3/1990 | |
| EP | 0650827 | A2 | 5/1995 | |
| EP | 0889779 | A2 | 1/1999 | |
| EP | 0903219 | A2 | 3/1999 | |
| EP | 1065162 | A2 | 1/2001 | |
| EP | 1223107 | A1 | 7/2002 | |
| EP | 1373112 | A1 | 1/2004 | |
| EP | 1428759 | A2 | 6/2004 | |
| EP | 1997736 | A2 | 12/2008 | |
| EP | 1497049 | B1 | 3/2010 | |
| EP | 2228206 | A1 | 9/2010 | |
| EP | 2377764 | A1 | 10/2011 | |
| EP | 3231594 | A1 | 10/2017 | |
| FR | 0428967 | A | 9/1911 | |
| FR | 1020458 | A | 2/1953 | |
| FR | 1592372 | A | 5/1970 | |
| FR | 2721301 | A1 | 12/1995 | |
| FR | 2770445 | A1 | 5/1999 | |
| FR | 2808722 | A1 | 11/2001 | |
| FR | 2814393 | A1 | 3/2002 | |
| FR | 2770445 | A1 * | 5/2012 | ..... B31B 50/00 |
| FR | 2976561 | A1 | 12/2012 | |
| GB | 0166622 | | 7/1921 | |
| GB | 0983946 | A | 2/1965 | |
| GB | 1362060 | A | 7/1974 | |
| GB | 1546789 | A | 5/1979 | |
| JP | 49-099239 | A | 9/1974 | |
| JP | 50-078616 | A | 6/1975 | |
| JP | 51-027619 | A | 3/1976 | |
| JP | 55-057984 | A | 4/1980 | |
| JP | 56-089937 | A | 7/1981 | |
| JP | 59-031140 | A | 2/1984 | |
| JP | 59-176836 | A | 10/1984 | |
| JP | 61-118720 | A | 6/1986 | |
| JP | 61-242837 | A | 10/1986 | |
| JP | 01-133164 | A | 5/1989 | |
| JP | 02-182443 | A | 7/1990 | |
| JP | 03-070927 | A | 3/1991 | |
| JP | 06-099526 | A | 4/1994 | |
| JP | 06-320648 | A | 11/1994 | |
| JP | 07-156305 | A | 6/1995 | |
| JP | 08-238690 | A | 9/1996 | |
| JP | 08-333036 | A | 12/1996 | |
| JP | 2000-323324 | A | 11/2000 | |
| JP | 2003-079446 | A | 3/2003 | |
| JP | 2003-165167 | A | 6/2003 | |
| JP | 2005-067019 | A | 3/2005 | |
| JP | 2005-219798 | A | 8/2005 | |
| JP | 2006-289914 | A | 10/2006 | |
| JP | 2007-185799 | A | 7/2007 | |
| JP | 2008-254789 | A | 10/2008 | |
| JP | 2009-023074 | A | 2/2009 | |
| JP | 2009-132049 | A | 6/2009 | |
| JP | 2011-520674 | A | 7/2011 | |
| JP | 2011-230385 | A | 11/2011 | |
| JP | 2015-160428 | A | 9/2015 | |
| RU | 2015030 | C1 | 6/1994 | |
| RU | 2037425 | C1 | 6/1995 | |
| RU | 2089398 | C1 | 9/1997 | |
| RU | 2136503 | C1 | 9/1999 | |
| RU | 2180646 | C1 | 3/2002 | |
| RU | 2004136918 | A | 5/2006 | |
| RU | 2287432 | C2 | 11/2006 | |
| RU | 2398674 | C1 | 9/2010 | |
| RU | 2531785 | C2 | 10/2014 | |
| RU | 2600917 | C2 | 10/2016 | |
| SE | 450829 | B | 8/1987 | |
| SE | 0450829 | B | 8/1987 | |
| SE | 541921 | C2 | 1/2020 | |
| SE | 1851054 | A1 | 3/2020 | |
| SE | 2050379 | A1 | 3/2020 | |
| SE | 543046 | C2 | 9/2020 | |
| SU | 1054863 | A1 | 11/1983 | |
| SU | 1121156 | A1 | 10/1984 | |
| SU | 1718783 | A1 | 3/1992 | |
| SU | 1756211 | A1 | 8/1992 | |
| WO | 96/14773 | A1 | 5/1996 | |
| WO | 97/31773 | A2 | 9/1997 | |
| WO | 99/17923 | A1 | 4/1999 | |
| WO | 02/79062 | A1 | 10/2002 | |
| WO | 03/89163 | A2 | 10/2003 | |
| WO | 2009/093936 | A1 | 7/2009 | |
| WO | 2010/091043 | A1 | 8/2010 | |
| WO | 2011/007237 | A1 | 1/2011 | |
| WO | 2011/100078 | A2 | 8/2011 | |
| WO | 2011/135433 | A1 | 11/2011 | |
| WO | 2012/003167 | A1 | 1/2012 | |
| WO | 2013/071073 | A1 | 5/2013 | |
| WO | 2013/071080 | A1 | 5/2013 | |
| WO | 2013/106180 | A1 | 7/2013 | |
| WO | 2013/114057 | A2 | 8/2013 | |
| WO | 2014/048934 | A1 | 4/2014 | |
| WO | 2014/117816 | A1 | 8/2014 | |
| WO | 2014/117817 | A1 | 8/2014 | |
| WO | 2015/173744 | A1 | 11/2015 | |
| WO | 2016/176271 | A1 | 11/2016 | |
| WO | 2017/203401 | A1 | 11/2017 | |
| WO | 2017/218296 | A1 | 12/2017 | |
| WO | 2017/218297 | A1 | 12/2017 | |

OTHER PUBLICATIONS

Office Action received for U.S. Appl. No. 15/616,688, dated Mar. 19, 2020.

Office Action received for U.S. Appl. No. 15/872,770, dated Mar. 27, 2020.

(56) References Cited

OTHER PUBLICATIONS

Office Action received for U.S. Appl. No. 15/901,089, dated Apr. 13, 2020.
Office Action received for U.S. Appl. No. 16/109,261, dated Apr. 28, 2020.
Office Action received for U.S. Appl. No. 29/419,922, dated Aug. 6, 2013.
Office Action received for U.S. Appl. No. 14/370,729 dated Jan. 26, 2017.
Final Office Action received for U.S. Appl. No. 13/147,787, dated Apr. 17, 2015.
Final Office Action received for U.S. Appl. No. 13/147,787, dated Feb. 16, 2016.
Final Office Action received for U.S. Appl. No. 13/147,787, dated Mar. 7, 2017.
Final Office Action received for U.S. Appl. No. 14/357,183, dated Nov. 12, 2015.
Final Office Action received for U.S. Appl. No. 14/357,190, dated Aug. 1, 2017.
Final Office Action received for U.S. Appl. No. 14/370,729, dated Jul. 12, 2017.
Final Office Action received for U.S. Appl. No. 15/872,770, dated Sep. 16, 2020, 17 pages.
Final Office Action received for U.S. Appl. No. 16/224,708, dated May 5, 2021, 24 pages.
International Search Report and Wirtten Opinion for application No. PCT/US2012/070719 dated Feb. 25, 2013.
International Search Report and Written Opinion for application No. PCT/US2017/036603 dated Oct. 18, 2017.
International Search Report and Written Opinion for application No. PCT/US2017/036606 dated Oct. 24, 2017.
International Search Report and Written Opinion for PCT/US18/14275 dated Apr. 4, 2018.
International Search Report and Written Opinion for PCT/US19/62696 dated Feb. 4, 2020.
International Search Report and Written Opinion for PCT/US2015/67375 dated Mar. 11, 2016.
International Search Report and Written Opinion for PCT/US2019/049102 dated Dec. 2, 2019.
International Search Report and Written Opinion from International Application No. PCT/US2010/022983 dated Apr. 13, 2010.
International Search Report and Written Opinion issued in PCT/US2019/038142 dated Aug. 19, 2019.
International Search Report and Written Opinion PCT/IB2019/052793 dated Nov. 11, 2019.
International Search Report and Written Opinion PCT/IB2019/052794 dated Jun. 19, 2019.
International Search Report and Written Opinion received for PCT Patent Application No. PCT/US2018/020928, dated Jun. 7, 2018, 9 pages.
International Search Report and Written Opinion received for PCT Patent Application No. PCT/US2019/049535, dated Jun. 9, 2020, 14 pages.
International Search Report and Written Opinion received for PCT Patent Application No. PCT/US2020/012519, dated Jun. 26, 2020, 19 pages.
International Search Report and Written Opinion, PCT/US2012/064403, US Search Authority, Completed Mar. 26, 2013, dated Apr. 8, 2013.
International Search Report and Written Opinion, PCT/US2012/064414, US Search Authority, Completed Jan. 4, 2013, dated Jan. 25, 2013.
International Search Report for PCT/US2011/042096 dated Oct. 28, 2011.
Non-Final Office Action received for U.S. Appl. No. 15/872,770, dated Nov. 10, 2020, 24 pages.
Non-Final Office Action received for U.S. Appl. No. 16/224,708, dated Jan. 15, 2021, 19 pages.
Non-Final Office Action received for U.S. Appl. No. 16/310,406, dated Aug. 19, 2020, 22 pages.
Non-Final Office Action received for U.S. Appl. No. 16/491,088, dated Aug. 5, 2021, 11 pages.
Non-Final Office Action received for U.S. Appl. No. 17/416,811, dated Apr. 27, 2022, 9 pages.
Notice of Allowance and Fees Due (PTOL-85) dated Aug. 27, 2021 for U.S. Appl. No. 16/224,708.
Notice of Allowance and Fees Due (PTOL-85) dated Jul. 8, 2021 for U.S. Appl. No. 16/224,708.
Notice of Allowance and Fees Due (PTOL-85) dated Sep. 9, 2021 for U.S. Appl. No. 16/224,708.
Notice of Allowance and Fees Due (PTOL-85) dated Sep. 28, 2021 for U.S. Appl. No. 16/224,708.
Notice of Allowance received for U.S. Appl. No. 13/147,787, dated Jun. 26, 2017.
Notice of Allowance received for U.S. Appl. No. 13/805,602, dated Mar. 21, 2016.
Notice of Allowance received for U.S. Appl. No. 14/357,183, dated Jan. 29, 2016.
Notice of Allowance received for U.S. Appl. No. 14/357,190, dated Dec. 5, 2017.
Notice of Allowance received for U.S. Appl. No. 14/357,190, dated Jan. 12, 2018.
Notice of Allowance received for U.S. Appl. No. 14/370,729, dated May 21, 2018.
Notice of Allowance received for U.S. Appl. No. 14/970,224, dated Aug. 13, 2018.
Notice of Allowance received for U.S. Appl. No. 29/419,922, dated Nov. 29, 2013.
Office Action received for U.S. Appl. No. 13/147,787, dated Aug. 27, 2014.
Office Action received for U.S. Appl. No. 13/147,787, dated Oct. 28, 2016.
Office Action received for U.S. Appl. No. 13/147,787, dated Sep. 30, 2015.
Office Action received for U.S. Appl. No. 13/805,602, dated Dec. 2, 2015.
Office Action received for U.S. Appl. No. 14/357,183, dated Jul. 16, 2015.
Office Action received for U.S. Appl. No. 14/357,190, dated Feb. 17, 2017.
Office Action received for U.S. Appl. No. 14/370,729, dated Dec. 19, 2017.
Final Office Action received for U.S. Appl. No. 17/416,811, dated Dec. 7, 2022, 23 pages.
Non-Final Office Action received for U.S. Appl. No. 17/264,808, dated Sep. 8, 2022, 8 pages.

* cited by examiner

BOX ERECTING METHOD AND SYSTEM

CROSS-REFERENCE TO RELATED APPLICATIONS

The present application is a divisional of U.S. application Ser. No. 16/491,088, filed Sep. 4, 2019, and entitled A Box Erecting Method and System, which claims priority to PCT Application No. PCT/US2018/020928, filed Mar. 5, 2018, and entitled A BOX ERECTING METHOD AND SYSTEM, which claims the benefit of and priority to Sweden Application No. 1750247-7, filed Mar. 6, 2017. All of the aforementioned applications are incorporated by reference herein in their entireties.

BACKGROUND

Technical Field

The present invention relates to a box erecting method and system and to a box production method and system.

Related Art

Erecting boxes from box templates in for example shipping and packaging industries can be done manually and/or with help from some erecting tools. These tools could for example comprise vacuum tools for gripping certain parts of a box template while folding other parts, such as for example a bottom of the box. Automatic erecting of boxes may encounter problems for example when different sizes of boxes should be erected with use of the same tools and/or if the box walls are not as stable as required, for example due to folds provided in the templates due to a fanfold storage of the template material.

Shipping and packaging industries frequently use cardboard and other sheet material processing equipment that converts sheet materials into box templates. One advantage of such equipment is that a shipper may prepare boxes of required sizes as needed in lieu of keeping a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as reduce the waste and costs associated with the inherently inaccurate process of forecasting box size requirements, as the items shipped and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 65% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Customized sized boxes also reduce the shipping costs associated with shipping items compared to shipping the items in oversized boxes. A shipping vehicle filled with boxes that are 65% larger than the packaged items is much less cost efficient to operate than a shipping vehicle filled with boxes that are custom sized to fit the packaged items. In other words, a shipping vehicle filled with custom sized packages can carry a significantly larger number of packages, which can reduce the number of shipping vehicles required to ship the same number of items. Accordingly, in addition or as an alternative to calculating shipping prices based on the weight of a package, shipping prices are often affected by the size of the shipped package. Thus, reducing the size of an item's package can reduce the price of shipping the item. Even when shipping prices are not calculated based on the size of the packages (e.g., only on the weight of the packages), using custom sized packages can reduce the shipping costs because the smaller, custom sized packages will weigh less than oversized packages due to using less packaging and filling material.

A typical box template production system includes a converting part that cuts, scores, and/or creases sheet material to form a box template. The sheet material can be provided to the system from fanfolded bales. The fanfold storage of the sheet material provides unwanted fanfold folds to the box templates. These folds could be a problem when erecting the boxes, especially if tools for automatic erection are used.

BRIEF SUMMARY

It is an object of the present invention to provide an improved method and system for erecting boxes.

It is a further object of the invention to provide a method and a system for erecting boxes which is automated and flexible.

This is achieved in a method and a system for erecting boxes according to the independent claims.

In one aspect of the invention a method for erecting boxes from box templates of different sizes is provided. Said method comprises the steps of:

- adjusting a size of a frame according to a size of a box template which should be erected;
- wrapping the box template to be erected around the frame; and
- separating the frame from the box template.

In another aspect of the invention a box erecting system for erecting boxes from box templates of different sizes is provided. Said box erecting system comprises:

- a frame comprising adjustable parts defining a size of the frame; and
- a control system connected to said frame and configured for:
  - adjusting a size of the frame by adjusting said adjustable parts according to a size of a box template which should be erected; and
  - wrapping the box template to be erected around the frame.

Hereby, thanks to the size adjustable frame, box templates of different sizes can be erected by the same tool. Furthermore, by wrapping the box template around a frame a stability is provided to the wrapped box template. The box template is wrapped around the frame before a manufacturer's joint is sealed and hereby both the sealing of the manufacturer's joint and further folding for example of a bottom of the box can be provided efficiently. A frame inside the wrapped box template provides stability to the box irrespective of the robustness of each side wall. Hereby also box templates comprising folds from fanfold storage can be erected with less manual steps required.

A further object of the invention is to provide an improved method and a system for producing boxes.

This is achieved by a method for producing boxes from sheet material, said method comprising the steps of:

- producing box templates of different sizes from sheet material;
- erecting the box templates according to the method for erecting boxes as described above.

This is also achieved by a box production system comprising:

- at least one inlet for receiving sheet material;
- at least one converter part configured for receiving said sheet material and convert said sheet material into box templates of different sizes according to given instructions;
- at least one box erecting system as described above configured for erecting box templates provided from the at least one converter part.

Hereby boxes can be produced efficiently in different sizes. An automatic or partly automatic erection of the boxes can be provided close to a box template production system. In one embodiment of the invention the method further comprises a step of sealing a manufacturer's joint of the box template and/or folding and possibly sealing a bottom of the box template before separating the frame from the box template. Hereby the stability from the frame is utilized also for these steps.

In one embodiment of the invention the step of folding a bottom of the box template comprises pushing two second opposing bottom flaps of the box template outwards from each other by at least two extendable pushing arms connected to the frame at least during an initial part of a folding of two first opposing bottom flaps of the box template for forming a bottom of the box and retracting said extendable pushing arms before folding said two second opposing bottom flaps for forming a bottom of the box. Hereby possible problems related to bottom flaps hindering each other from correct folding can be dealt with. This may be a problem especially when thin knife cutting is used for cutting the box templates instead of punching.

In one embodiment of the invention said step of wrapping comprises:

- attaching a box template to be erected to the frame;
- controlling the position of the frame by a control system connected to the frame such that the box template is wrapped around the frame.

In one embodiment of the invention the step of attaching the box template to the frame comprises attaching a first end of the box template to one of four corner posts provided in the frame. Hereby in one embodiment of the invention the adjustable parts of the frame comprise four corner posts and the control system is configured for controlling the position of said corner posts for different box sizes to be erected. Furthermore, in one embodiment of the invention at least one of the corner posts comprises an attachment device to which a first end of a box template can be attached during wrapping of the box template around the frame.

In one embodiment of the invention the controlling of the position of the frame comprises rotating the frame for wrapping the box template around the frame.

In one embodiment of the invention the step of sealing the manufacturer's joint comprising providing glue to a part of the box template which will be a part of the manufacturer's joint before the box template has been completely wrapped around the frame and thereafter complete the wrapping of the box template around the frame such that the manufacturer's joint is sealed. In one embodiment of the invention the step of sealing the manufacturer's joint further comprises controlling the position of the frame by a control system connected to the frame such that the box template is passing a sealing device before the box template is completely wrapped around the frame, said sealing device being connected to and controlled by the control system to eject glue to the box template for sealing the manufacturer's joint when the box template is passing.

In one embodiment of the invention the step of wrapping the box template around the frame comprises positioning a distant end of the frame in line with bottom flap creases of the box template such that a bottom can be folded while keeping the frame inside the wrapped box template.

DETAILED DESCRIPTION

Figure 1A:
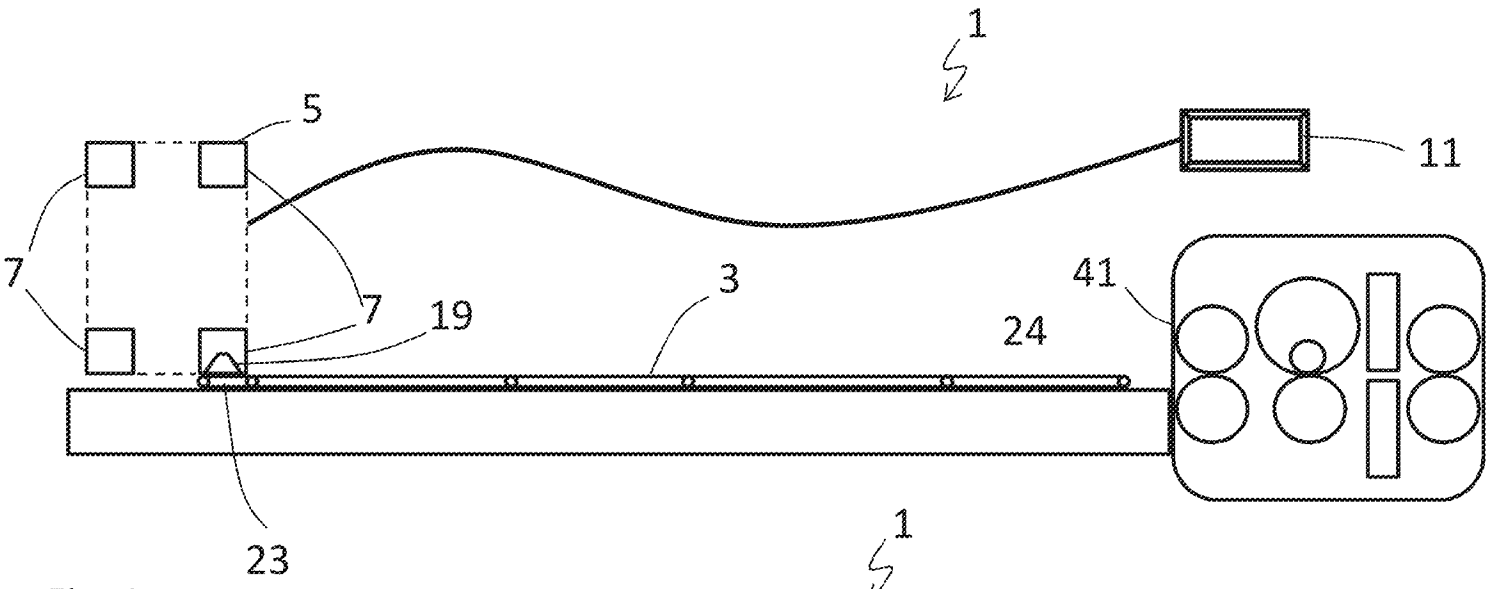
FIGS. 1*a*-1*d* show schematically a box erecting system according to one embodiment of the invention in four different positions.
Figure 1B:
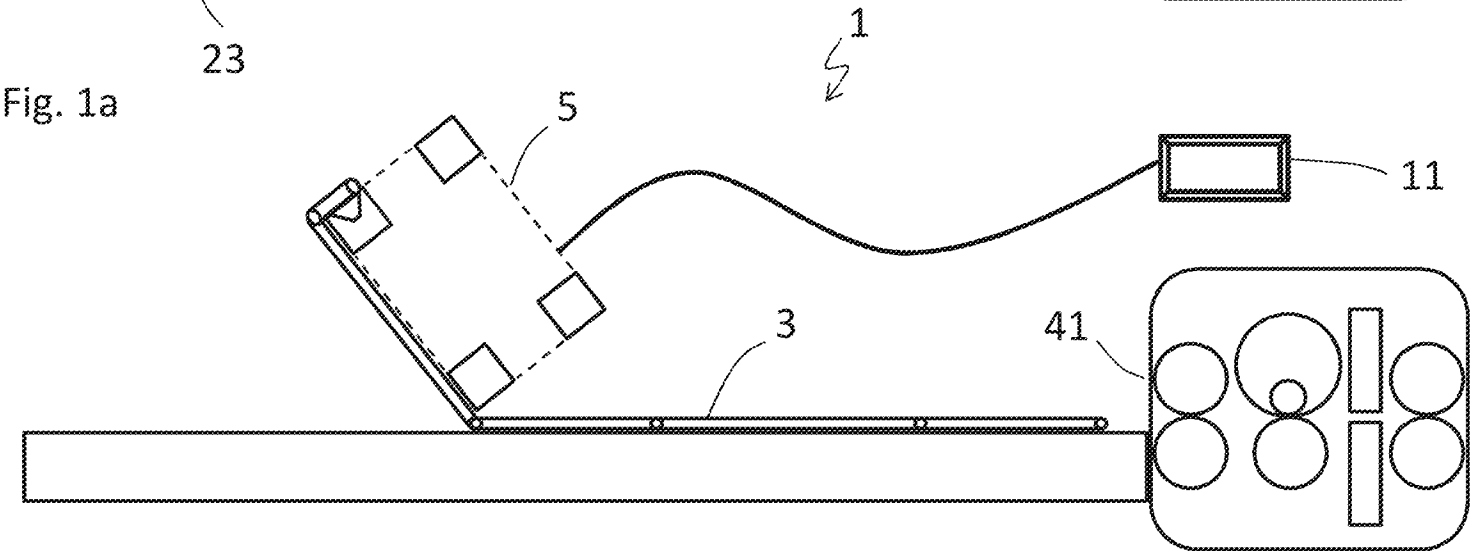
Figure 1C:
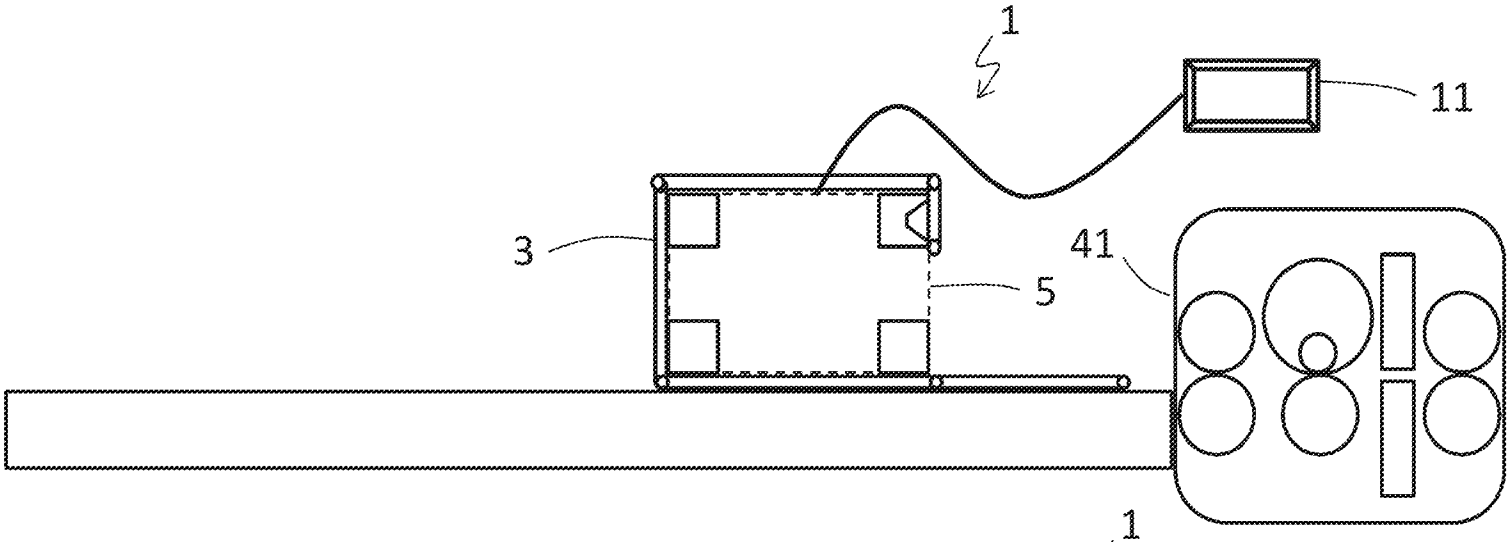
Figure 1D:
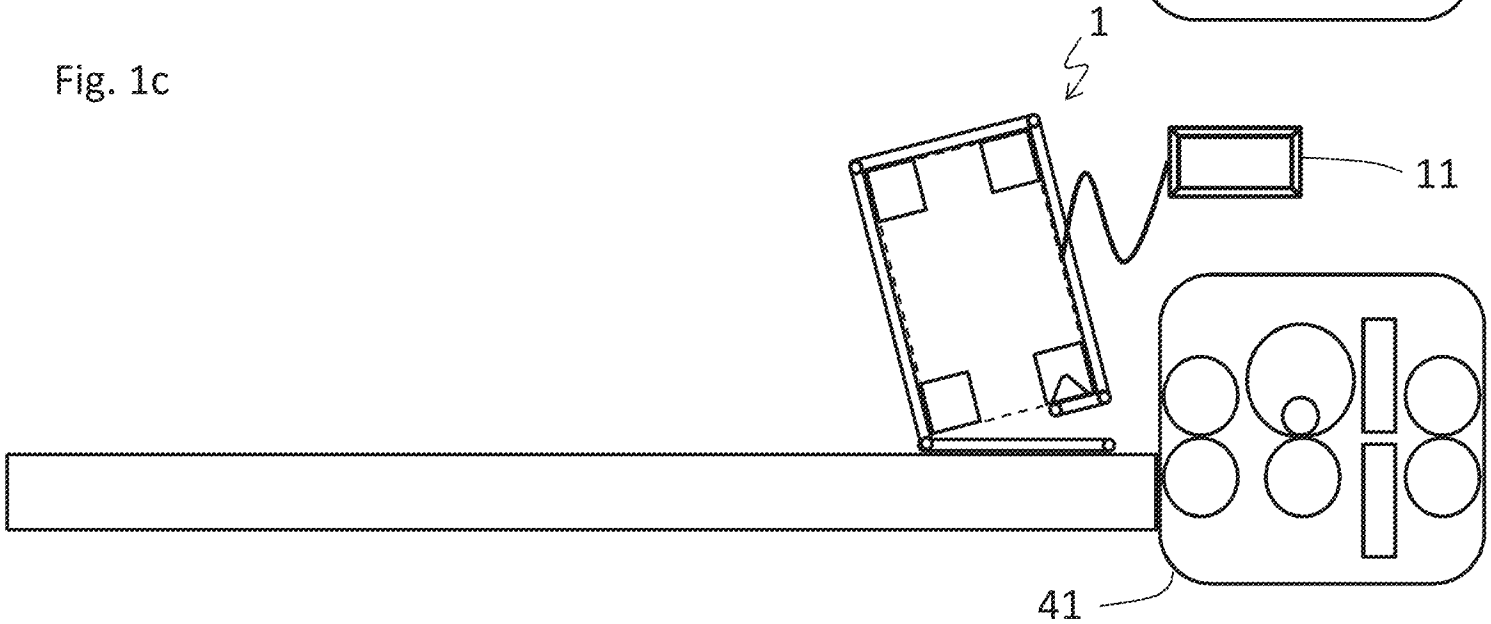
Figure 2A:
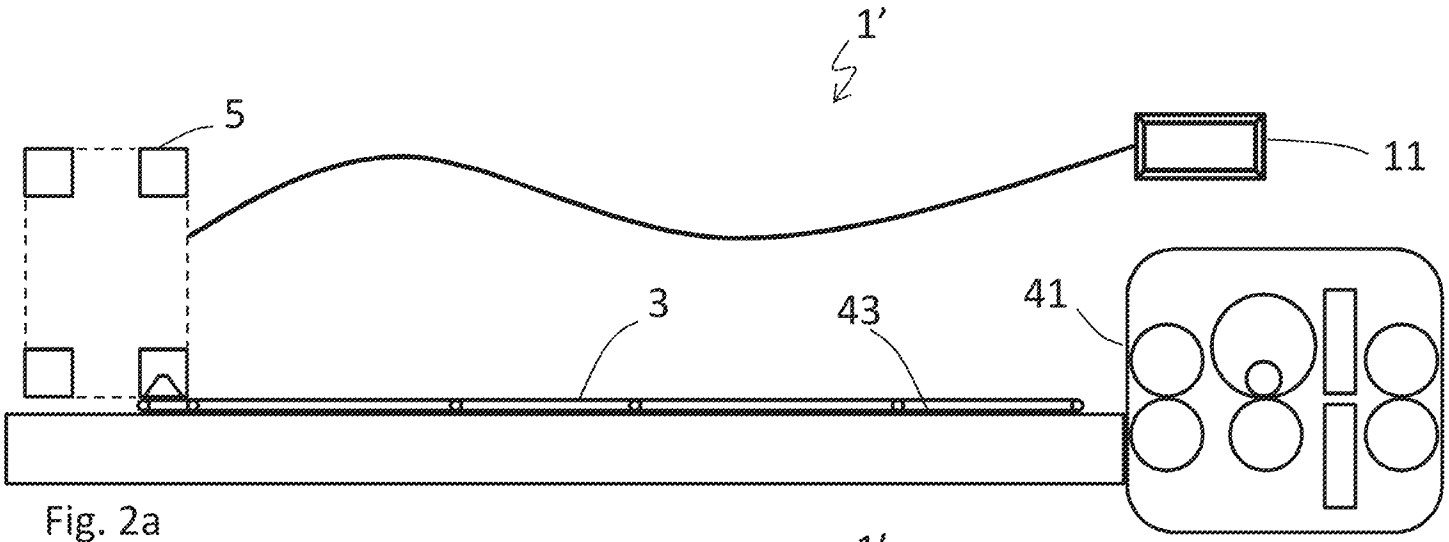
FIGS. 2*a*-2*d* show schematically a box erecting system according to another embodiment of the invention in four different positions.
Figure 2B:
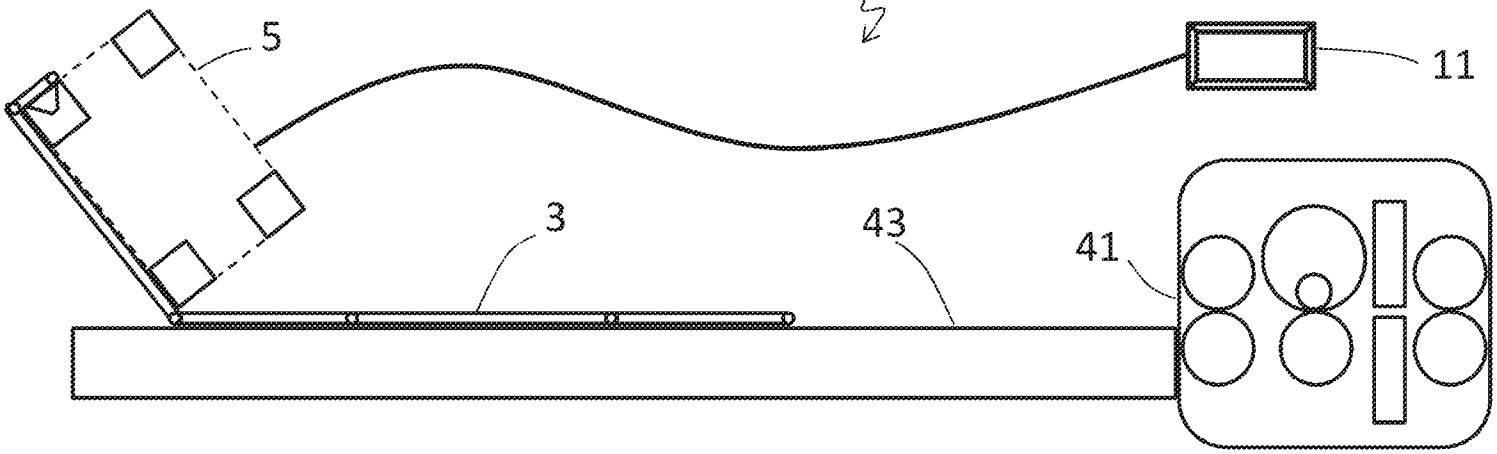
Figure 2C:
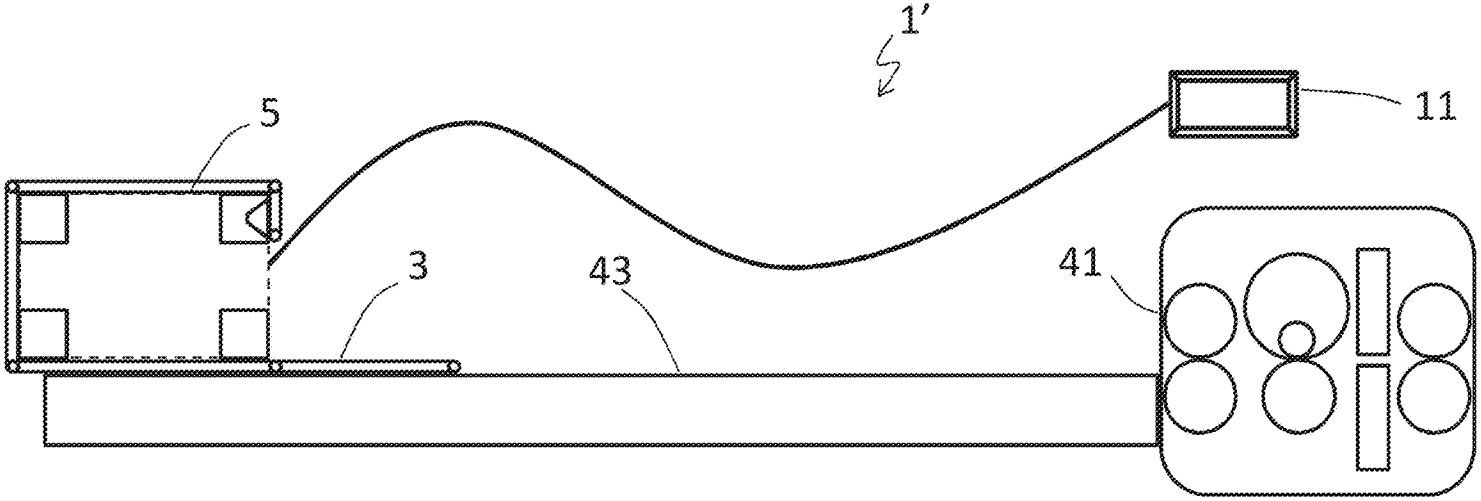
Figure 2D:
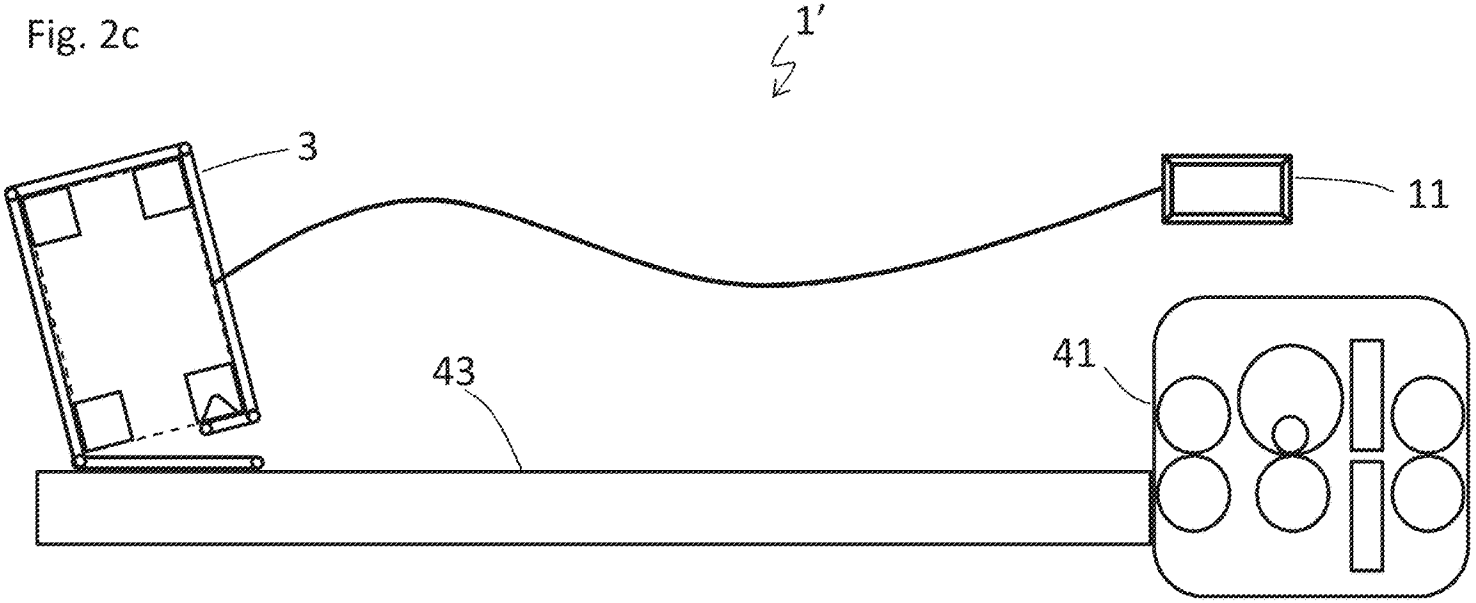
Figure 3A:
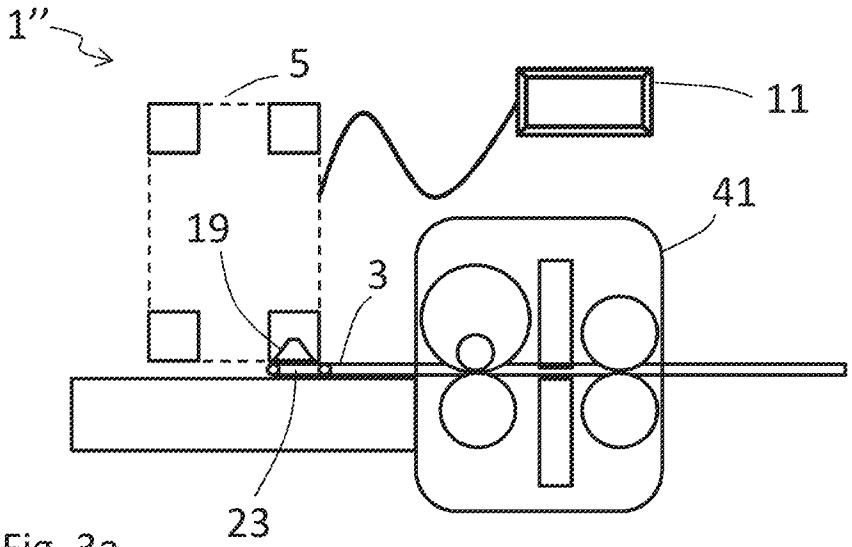
FIGS. 3*a*-3*d* show schematically a box erecting system according to still another embodiment of the invention in four different positions.
Figure 3B:
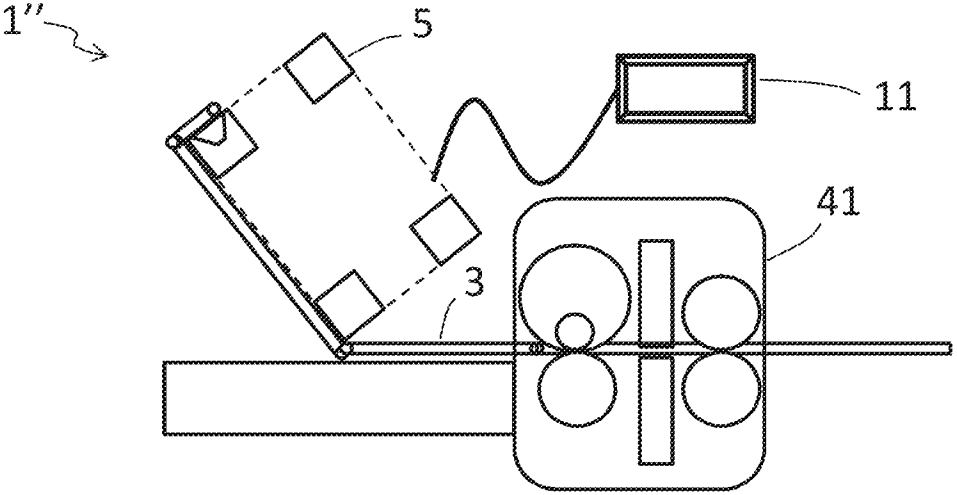
Figure 3C:
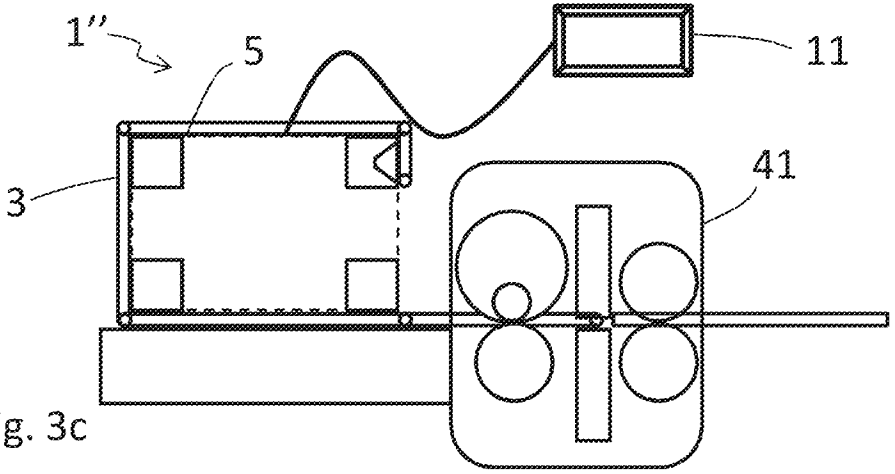
Figure 3D:
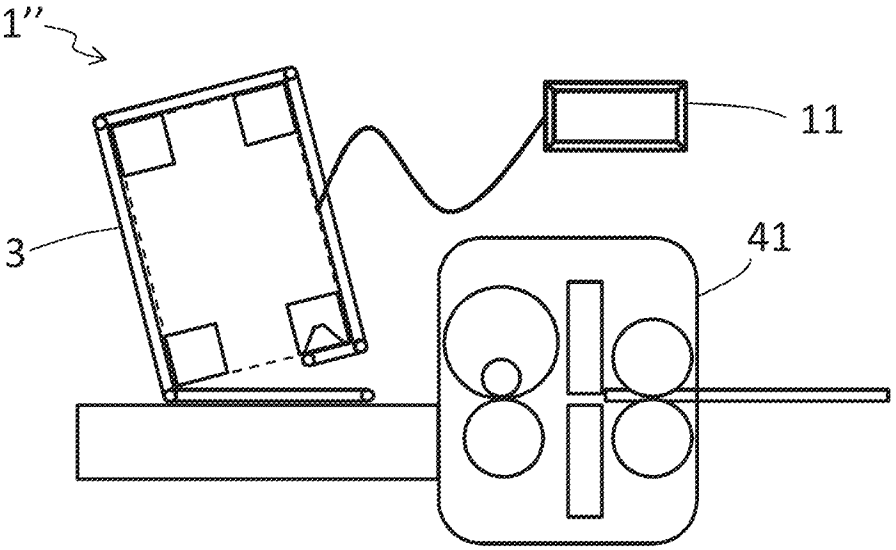

According to the invention a box erecting system and a method for erecting boxes from box templates of different sizes are provided. Referring to all the embodiments of the invention and all the drawings the method comprises in its broadest sense the steps of:

adjusting a size of a frame 5; 105 according to a size of a box template 3, 103 which should be erected;

wrapping the box template to be erected around the frame; and separating the frame from the box template.

Likewise, in its broadest sense the box erecting system 1; 101 according to the invention comprises:

a frame 5; 105 comprising adjustable parts 7; 107 defining a size of the frame; and a control system 11; 111 connected to said frame 5; 105 and configured for:

adjusting a size of the frame 5; 105 by adjusting said adjustable parts 7; 107 according to a size of a box template which should be erected; and wrapping the box template to be erected around the frame 5; 105.

The method and system according to the invention can be applied for different types of boxes, for example a so called Regular Slotted Container, RSC, also called Fefco 201 or American box or a Half Slotted Container HSC, also called Fefco 200.

FIGS. 1*a*-1*d* show schematically a box erecting system 1 according to one embodiment of the invention in four different positions. The box erecting system 1 comprises a frame 5 and a control system 11 connected to said frame 5. The frame 5 comprises adjustable parts 7, which are defining the size of the frame 5. In this embodiment of the invention the adjustable parts 7 comprises four corner posts 7 and the control system 11 is configured for controlling the position of said corner posts 7 in accordance with different box template sizes, i.e. in accordance with different box sizes to be erected. The four corner posts 7 are positioned to form a rectangular shape corresponding to a rectangular shape of the box to be erected. Each corner post 7 will in one embodiment of the invention be provided in a corner between two side walls of the erected box. An adjustment of the size of the frame can in one embodiment of the invention be to adjust the distances between the corner posts which distances corresponds to a width and a length of the box to be erected. In this embodiment of the invention at least one of the corner posts 7 comprises an attachment device 19 to which a first end 23 of a box template 3 can be attached during wrapping of the box template around the frame 5. This could for example be a suction cup or a clamp which can be controlled from the control system 11. In the embodiment shown in FIGS. 1*a*-1*d* a first end 23 of the box template is a glue tab provided for forming part of a manufacturer's joint. However, in another embodiment of the invention an overlap manufacturer's joint is not necessary but instead an edge to edge manufacturer's joint using tape sealing could be provided. In that case a first end 23 of the box template which is attached to one of the corner posts 7 is not a glue tab but simply the outermost end of the box template.

In this embodiment of the invention the control system 11 is configured for controlling the position of the frame 5 for wrapping the box template 3 around the frame 5. The control system 11 can control the attaching device 19 provided to at least one of the corner posts 7 to attach to a first end 23 of a box template 3 to be erected. The control system 11 is further in this embodiment configured to both rotate the frame 5 for wrapping the box template 3 around the frame 5 and transfer the frame along a box template extension. In the FIGS. 1*a*-1*d* it is shown that the frame 5 is transferred towards a converting part 41 of a box template production system from which the box template was delivered. However, in another embodiment the frame 5 could instead be provided at the other end of the box template, right at the outlet from the box template production system and be transferred in a direction away from the box template production system.

FIGS. 2*a*-2*d* show schematically a box erecting system 1' according to another embodiment of the invention in four different positions. Most of the details are the same as in the embodiment described in relation to FIGS. 1*a* and 1*b* and are therefore given the same reference numbers and will not be described again. The only difference is that the control system 11 in this embodiment is configured for controlling the frame to only rotate and not to be transferred along a box template extension. The box template 3 is instead transferred over a surface 43 onto which it is provided. i.e., the frame 5 will pull the box template 3 over the surface 43 to wrap it around the frame 5.

FIGS. 3*a*-3*d* show schematically a box erecting system 1" according to still another embodiment of the invention in four different positions. In this embodiment the frame 5 is provided directly in connection with an outlet from a converting part 41 of a box template production system. Instead of delivering the box templates out from the converting part 41 onto a surface 43 as shown in the embodiments as described in relation to FIGS. 1 and 2, the box templates are in this embodiment of the invention directly wrapped around the frame 5. The control system 11 is hereby configured to first adjust the size of the frame 5 as described above. The control device 11 is further configured to control an attachment device 19 of the frame 5 to attach to a first end 23 of a box template 3 delivered from the converting part 41 and then to rotate the frame 5 such that the box template 3 is wrapped around the frame 5.

In all the embodiments described above in relation to FIGS. 1-3 a manufacturer's joint can be sealed for example by tape or glue (possibly controlled from the control system) and possibly also a bottom of the box can be folded and possibly also sealed before the frame is removed from the erected box and used for erecting a new box. Further details and examples are given below.

FIGS. 4-8 show a box erecting system 1 according to one embodiment of the invention in different positions. This embodiment of the invention corresponds in the principal details to the embodiment described in relation to FIGS. 1*a*-1*d*. Therefore, the same reference numbers are used for the same details and the description will not be repeated.

Figure 4:
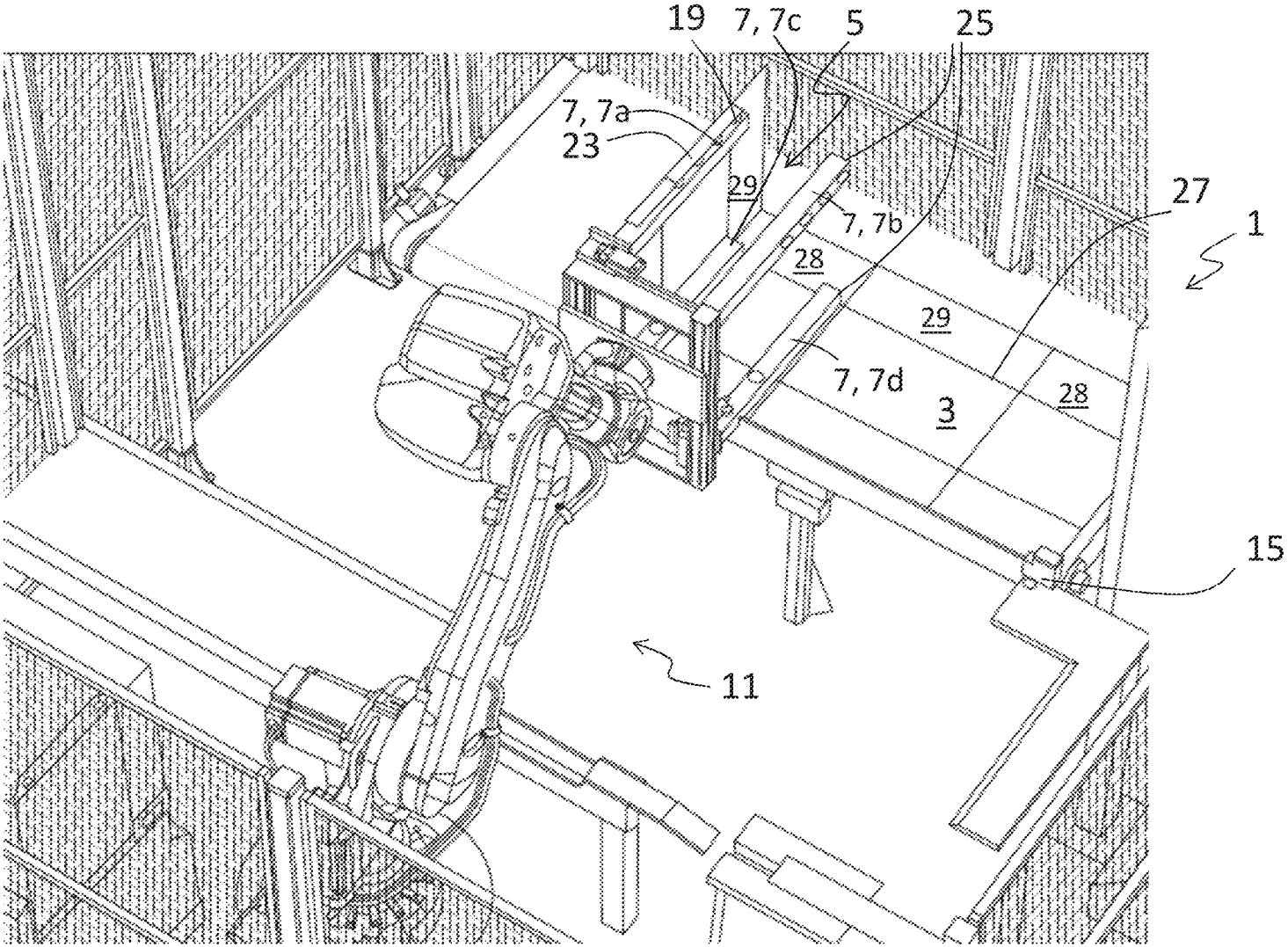
FIG. 4 shows a box erecting system according to one embodiment of the invention in a position where a box template is about to be wrapped around a frame of the box erecting system.

FIG. 4 shows the box erecting system 1 in a position where a box template 3 is about to be wrapped around a frame 5 of the box erecting system 1. The box erecting system 1 comprises a frame 5 and a control system 11 connected to said frame 5. The frame 5 comprises adjustable parts 7, which are defining the size of the frame 5 as described above. In this embodiment of the invention the frame comprises four corner posts 7*a*, 7*b*, 7*c*, 7*d*. If for example a Regular Slotted Container, RSC, or a Half Slotted Container, HSC, is erected each one of the four corner posts 7*a*-7*d* will be provided in an inside corner each of the box between two side walls of the box. Furthermore, a distance between a first one of the corner posts 7*a* and a second one of the corner posts 7*b* corresponds to a width of the finally erected box and a distance between the first corner post 7*a* and a third corner post 7*c* corresponds to a length of the finally erected box. When adjusting the size of the frame the distances between the corner posts are changed which distances correspond to the length and width of the finally erected box. Also as described above at least one of the corner posts 7 comprises an attachment device 19 to which a first end 23 of a box template 3 can be attached during wrapping of the box template around the frame 5. In the embodiment shown in FIG. 4 a first end 23 of the box template is a glue tab provided for forming part of a manufacturer's joint. However, as described above the first end 23 does not need to be a glue tab.

Furthermore, in this embodiment it can be seen that the control system 11 is configured for providing the frame 5 to the box template 3 with a distal end 25 of the frame 5 in line with bottom flap creases 27 of the box template 3 such that a bottom can be folded while keeping the frame 5 inside the wrapped box template.

In this embodiment of the invention the control system 11 is configured for controlling the position and orientation of the frame 5 for wrapping the box template 3 around the frame 5. The control system 11 can control the attaching device 19 provided to at least one of the corner posts 7 to attach to a first end 23 of a box template 3 to be erected. The control system 11 is further in this embodiment configured to rotate the frame 5 for wrapping the box template 3 around the frame 5. In this embodiment the frame 5 is both rotated and transferred along a box template extension as described above in relation to FIGS. 1*a*-1*d*. However, in another embodiment the frame could instead be controlled only to rotate by the control system 11 while the box template instead is transferred over a surface on to which it is provided. i.e. the frame will pull the box template over the surface to wrap it around the frame (as shown in FIGS. 2*a*-2*d*).

Figure 5:
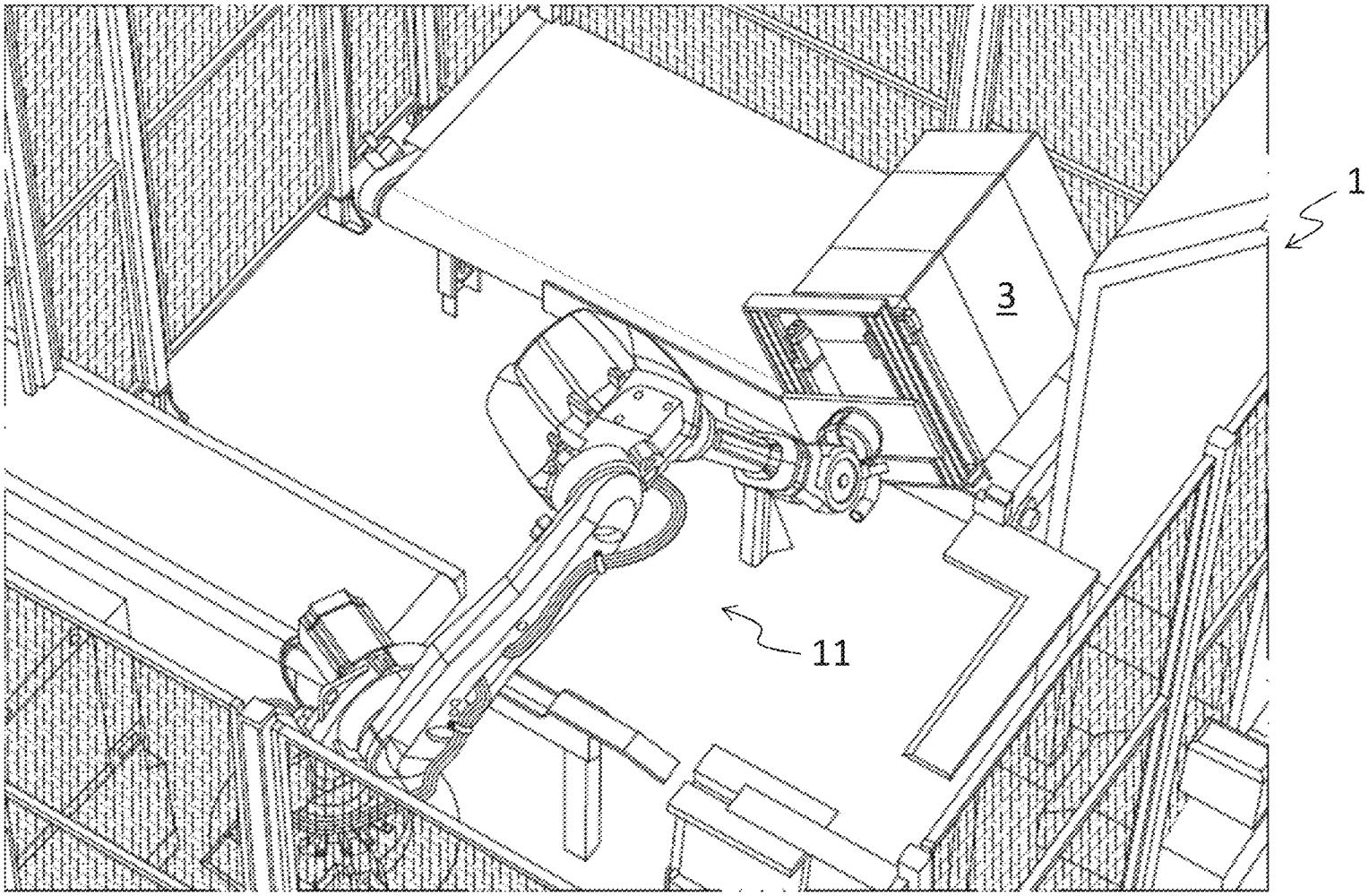
FIG. 5 shows the same box erecting system as shown in FIG. 4 in a position where a box template has been almost wrapped around the frame.
Figure 6:
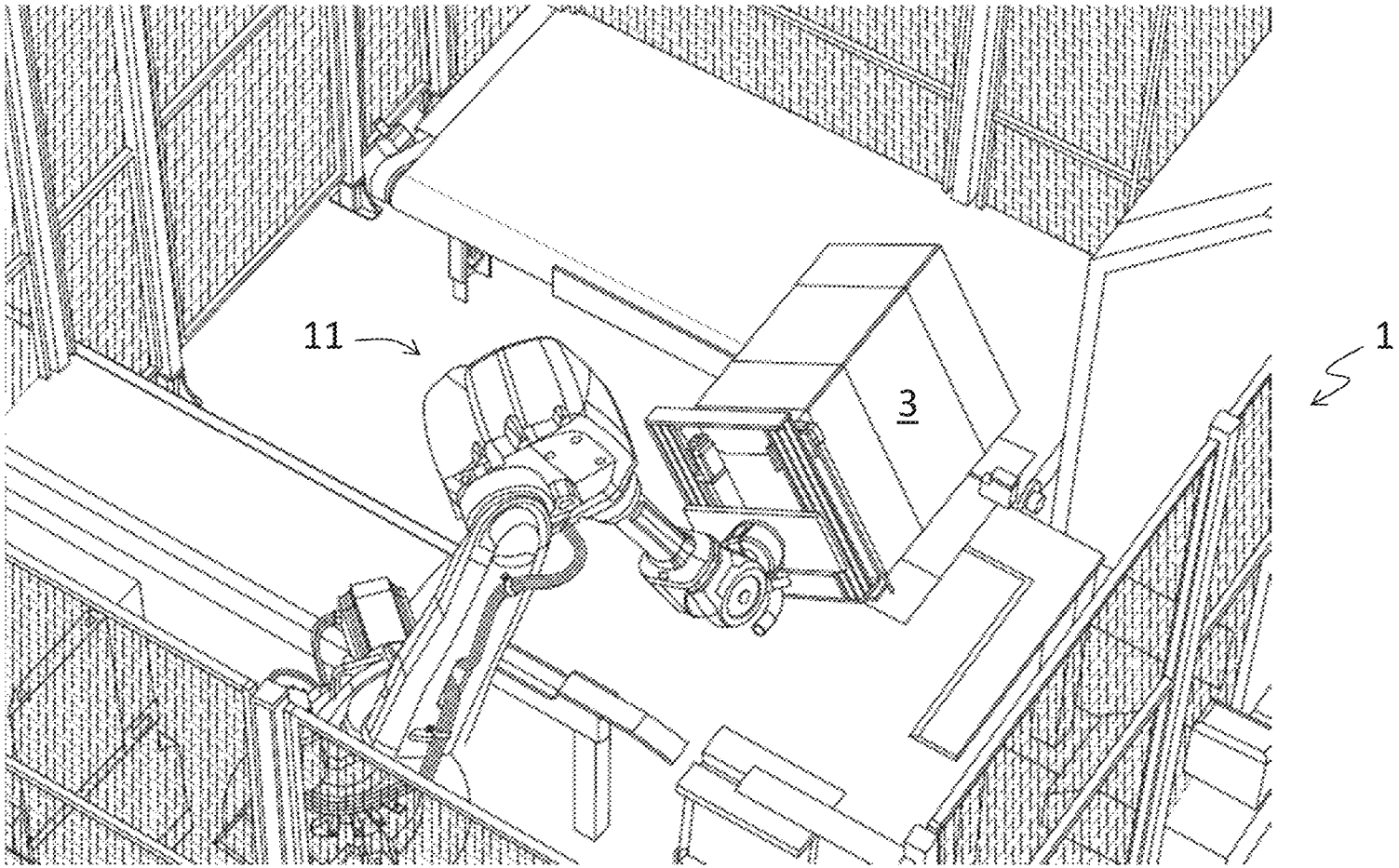
FIG. 6 shows the same box erecting system as shown in FIG. 4 in a position where the almost wrapped box template is controlled to pass in front of a sealing device for sealing of a manufacturer's joint.

FIG. 5 shows the same box erecting system 1 as shown in FIG. 4 in a position where a box template 3 has been almost wrapped around the frame 5. In this embodiment, where a glue tab is provided as a first end 23 of the box template 3 which is attached to the attaching device 19 of the frame 5, glue is being provided to either the glue tab or a second end 24 of the box template 3 which will be mating with the glue tab 23 when the box template is completely wrapped around the frame. The sealing between the glue tab 23 and the second end 24 of the box template is referred to as the manufacturer's joint. Hereby in this embodiment of the invention the method comprises a step of sealing a manufacturer's joint before the frame is separated from the box template. The box erecting system comprises hereby a sealing device 15 which in this embodiment is in the form of a glue ejector 15. The glue ejector 15 is connected to the control system 11 and is controlled by the control system 11 to eject glue to the box template for sealing the manufacturer's joint when the box template is passing the sealing device 15. Hereby the step of sealing the manufacturer's joint comprises in this embodiment of the invention to control the position of the frame 5 by the control system 11 such that the box template 3 is passing a sealing device 15 which will eject glue to the box template before the box template is completely wrapped around the frame. The step of sealing the manufacturer's joint comprises providing glue to a part of the box template which will be a part of the manufacturer's joint before the box template has been completely wrapped around the frame and thereafter complete the wrapping of the box template around the frame such that the manufacturer's joint is sealed. The movement of the frame 5 together with the almost wrapped box template 3 such that the manufacturer's joint passes in front of the sealing device 15 is shown in FIG. 6. Alternatively, in another embodiment of the invention the sealing device 15 (glue ejector) can be movable and be transferred along the box template for ejecting glue.

Figure 7A:
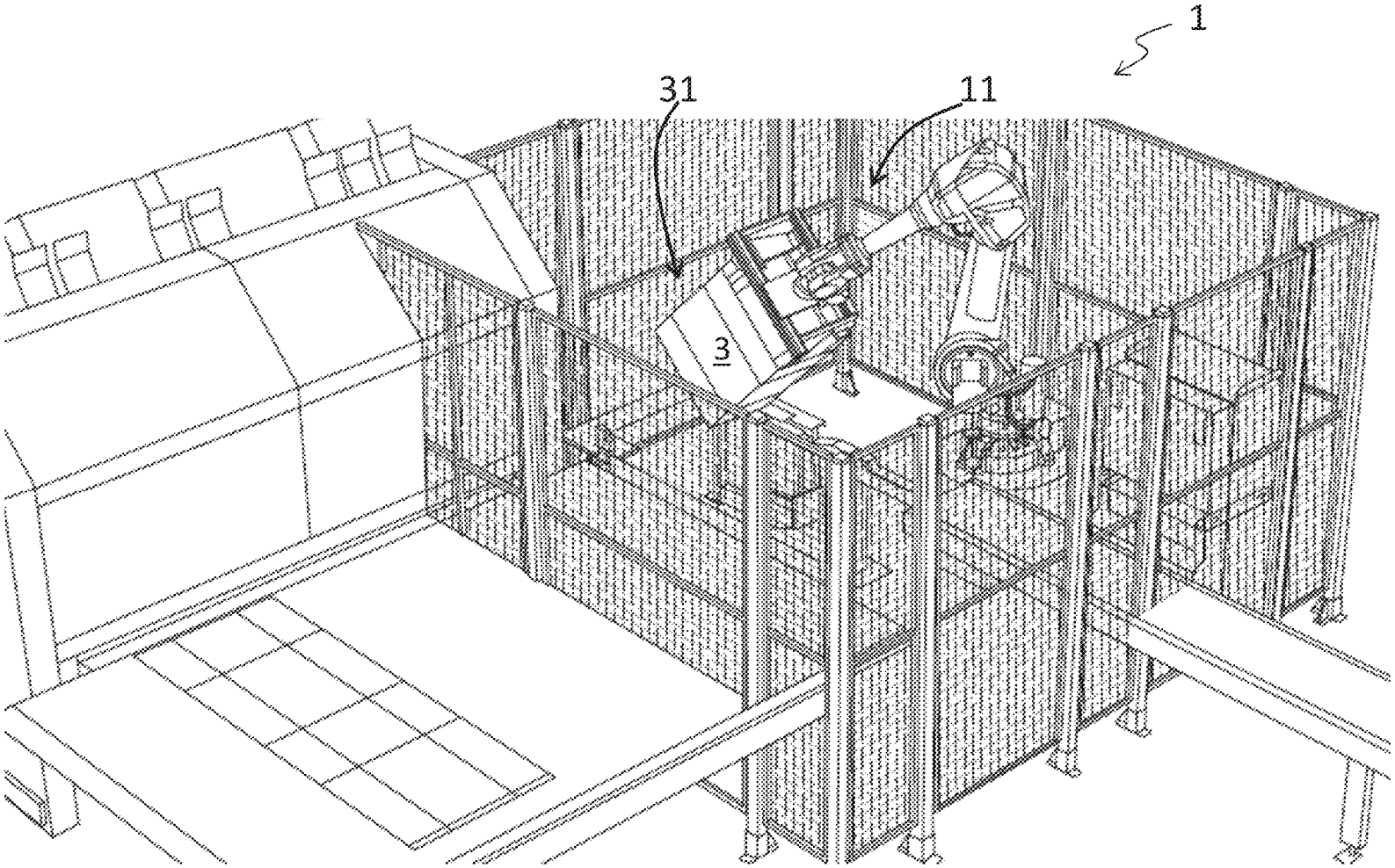
FIG. 7*a* shows the same box erecting system as shown in FIG. 4 in a position where minor flaps of a bottom of the box template are folded.

FIG. 7*a* shows the same box erecting system 1 as shown in FIG. 4 in a position where minor flaps of a bottom of the box template are folded. The flaps of a box forming a bottom (or a closed top) are usually referred to as minor and major flaps. However, the size of these flaps need not necessarily be minor and major in relation to each other. Hereafter the two opposing flaps which are first folded to form the bottom will be called first opposing bottom flaps 28 (usually called minor flaps) and the two remaining flaps are called second opposing bottom flaps 29 (usually called major flaps). The frame 5 holding the wrapped box template 3 is in this embodiment controlled by the control system 11 to pass a bottom folding station 31. In another embodiment of the invention the wrapped box template is delivered to a bottom folding station. In this embodiment a first part of the bottom folding station 31 is a bent rail 31 towards which the frame is pushed for folding of the first opposing bottom flaps 28. The bent configuration of the rail 31 ensures that the first opposing bottom flaps 28 are folded in a correct direction forming a bottom of the box.

Figure 7B:
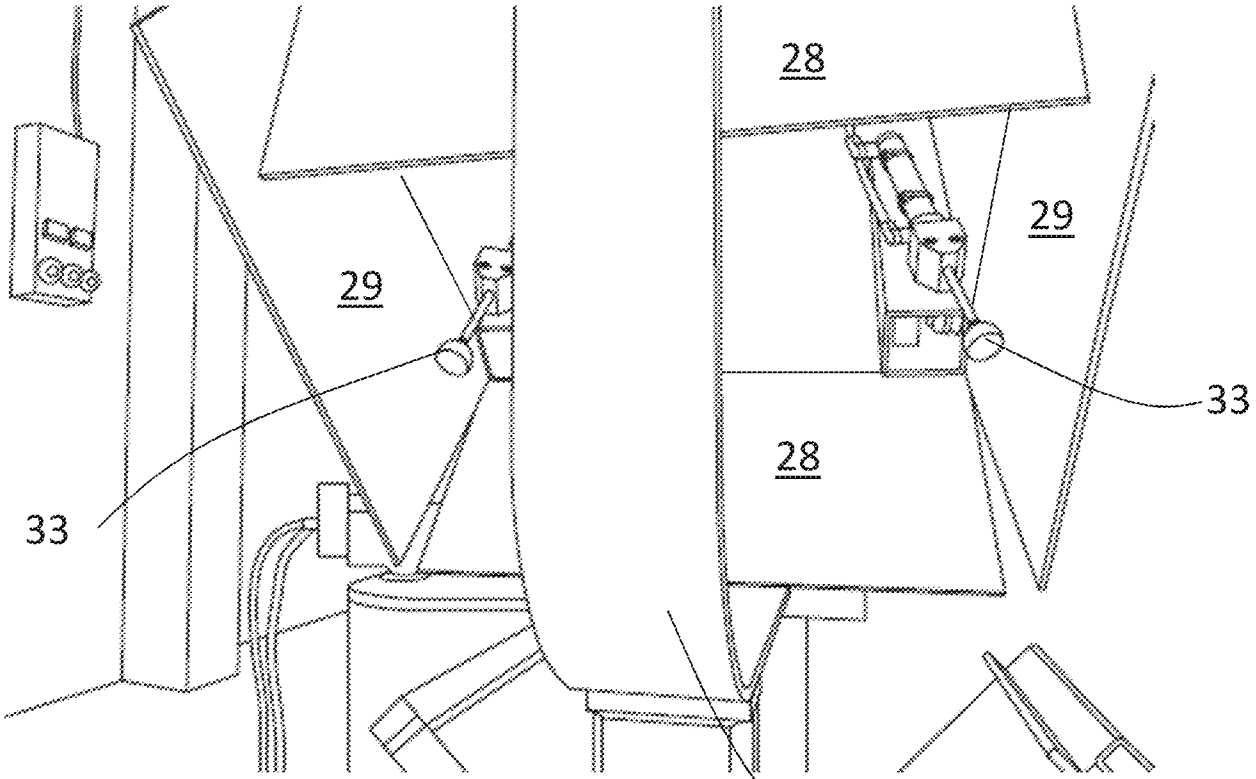
FIG. 7*b* shows one embodiment of a box erecting system in the same position as shown in FIG. 7*a* but from another view.
Figure 7C:
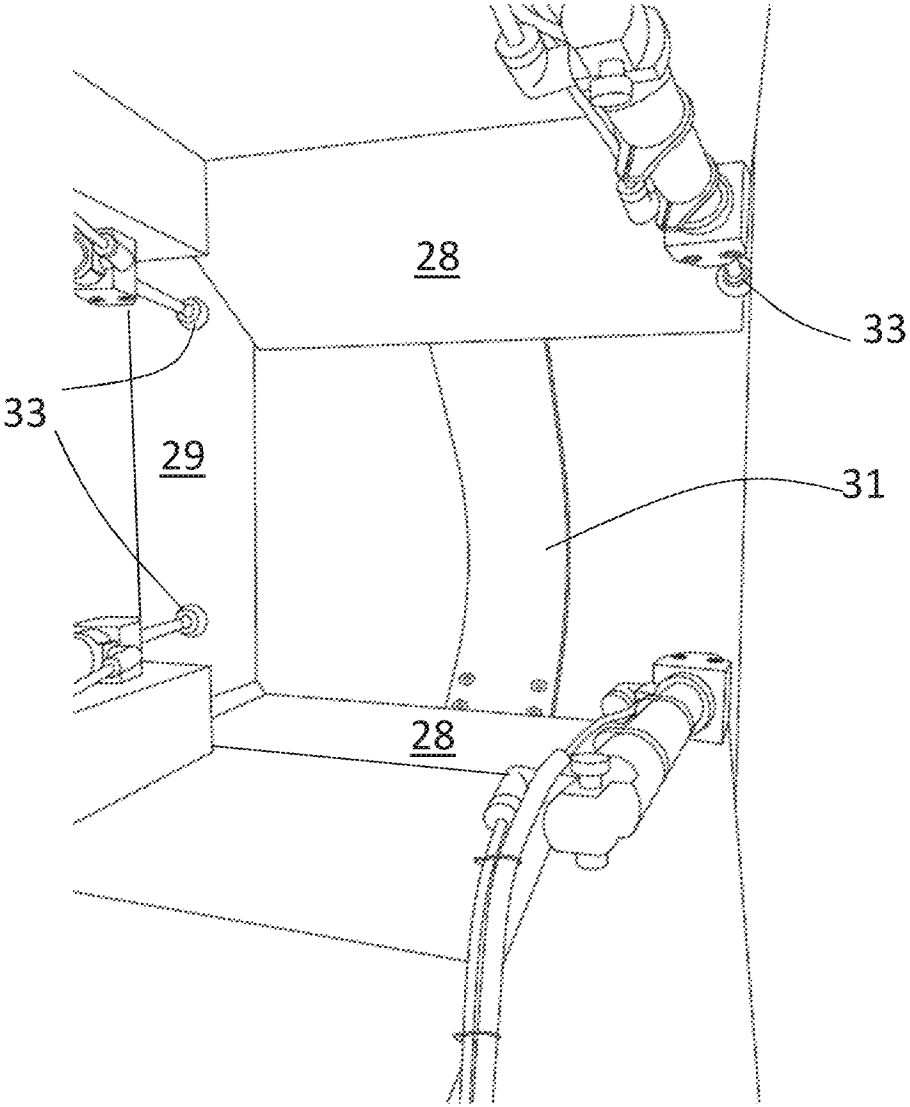
FIG. 7*c* shows the same embodiment as shown in FIG. 7*b* in a different view but in the same position.

FIGS. 7*b* and 7*c* show a further detail which could be added to the frame 5 in any one of the embodiments according to the invention. The box erecting system is in the same position as shown in FIG. 7*a* but from two other views. In this embodiment the frame 5 comprises extendable pushing arms 33 configured for pushing the two second opposing bottom flaps 29, also called major flaps, of the box template 3 outwards from each other at least during an initial part of the folding of the two first opposing bottom flaps 28, also called minor flaps, of the box template for forming a bottom of the box. Pushing the major flaps 29 outwards when the minor flaps 28 are folded is advantageous because hereby it can be avoided that the major flaps hinder the minor flaps from folding. These extendable pushing arms 33 can also be provided to all other embodiments of the invention. The use of a frame 5 and a control system 11 according to the invention for erecting boxes provides a possibility to add this function to push the major flaps outwards from each other. The extendable pushing arms 33 can be mounted to the frame 5, for example one to each corner post 7, and can be controlled by the control system 11.

The control system 11 is further configured for retracting said extendable pushing arms 33 such that they do not protrude outside the frame 5 when the major flaps (second opposing bottom flaps) 29 are to be folded for forming a bottom of the box. The major flaps can be folded by any kind of folding device (a second part of the bottom folding station 31, not shown) suitably connected to and controlled by the control system 11.

Figure 8:
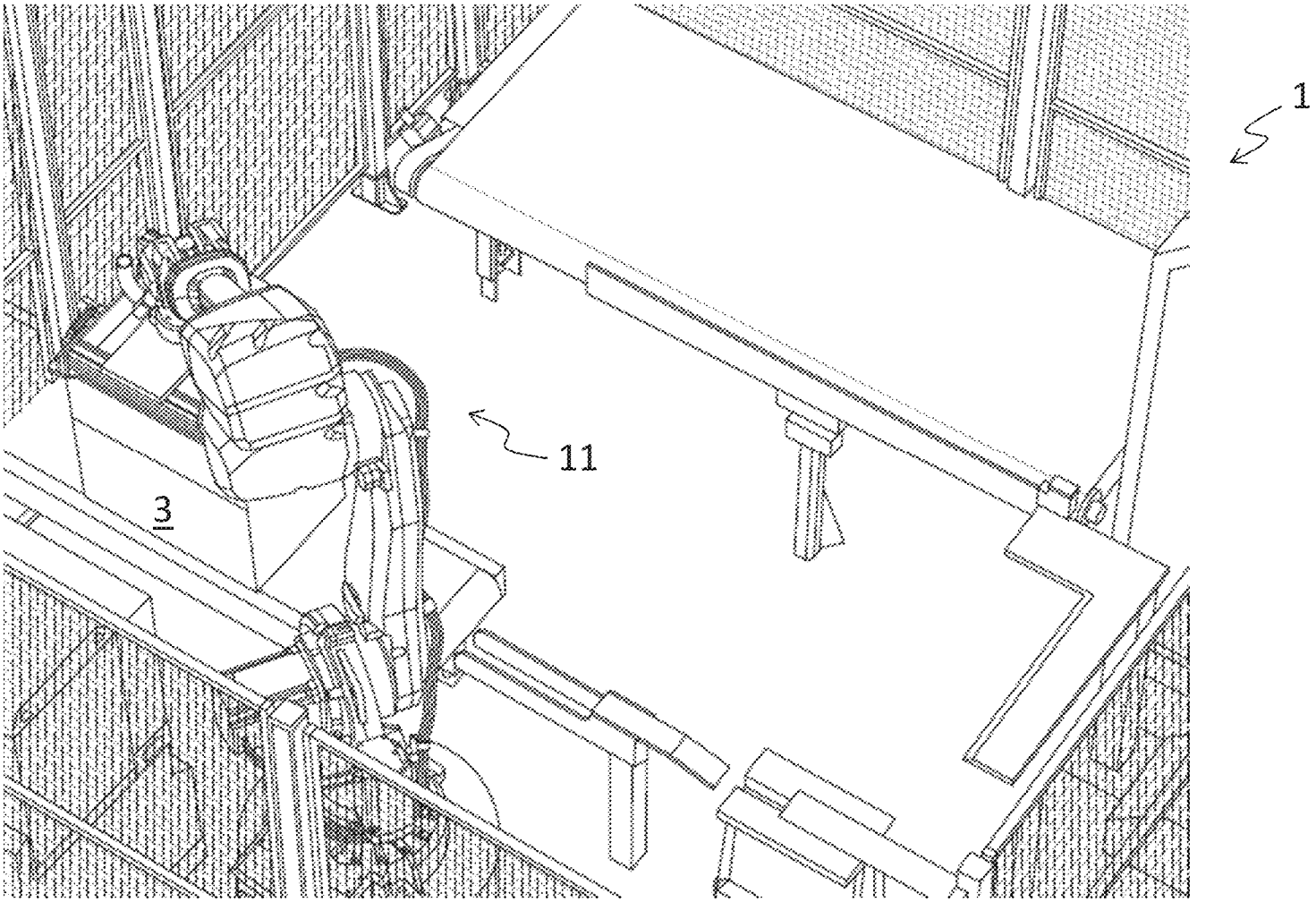
FIG. 8 shows the same box erecting system as shown in FIG. 4 in a position where the whole bottom has been folded and the frame is about to be removed from the erected box.

FIG. 8 shows the same box erecting system 1 as shown in FIG. 4 in a position where the whole bottom has been folded and the frame 5 is about to be removed from the erected box. The bottom can optionally be sealed by for example tape or glue before the frame is removed. The frame is then ready for erecting a new box template. If the new box template is of another size the positions of the adjustable parts 7 will be adjusted by the control system 11 according to the size of the new box template before the new box template is wrapped around the frame.

Figure 9:
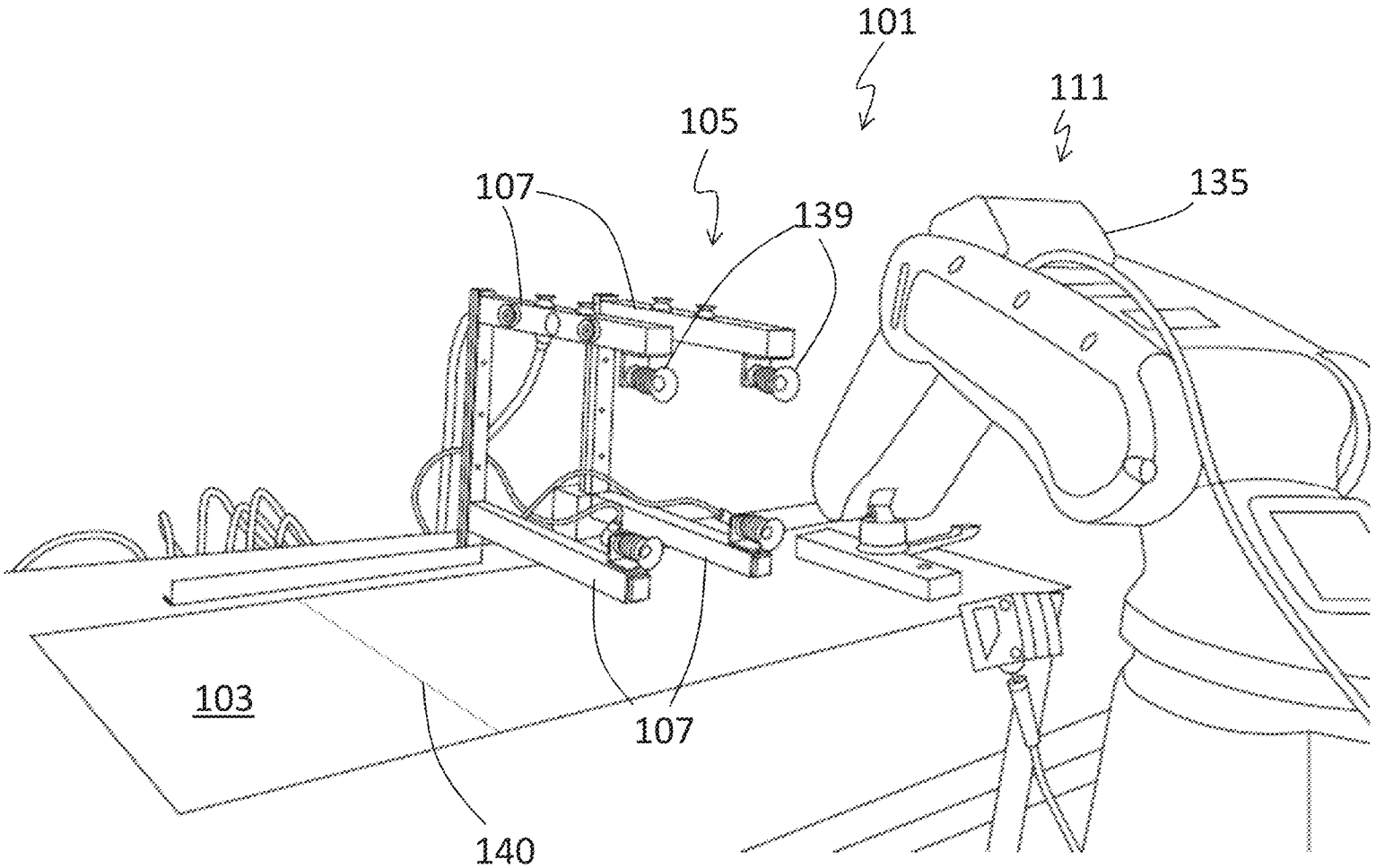
FIG. 9 shows a box erecting system according to another embodiment of the invention in a position where a box template is provided beneath a frame of the box erecting system.

FIG. 9 shows a box erecting system 101 according to another embodiment of the invention in a position where a box template 103 is provided beneath a frame 105 of the box erecting system 101. In this embodiment of the invention the frame 105 is stationary. The frame 105 comprises also in this embodiment adjustable parts 107 defining a size of the frame. A control system 111 is connected to the frame 105 and can adjust the positions of the adjustable parts 107 such that the size of the frame can be adapted to different box template sizes. The control system 111 comprises in this embodiment at least one robot arm 135 or another suitable equipment which can be controlled to hold a box template 103 and provide the box template beneath the frame 105. In this embodiment the box template is provided by the control system beneath the frame. However, in another embodiment of the invention the box template can be provided by the control system to the frame from the top or from the side.

Figure 10:
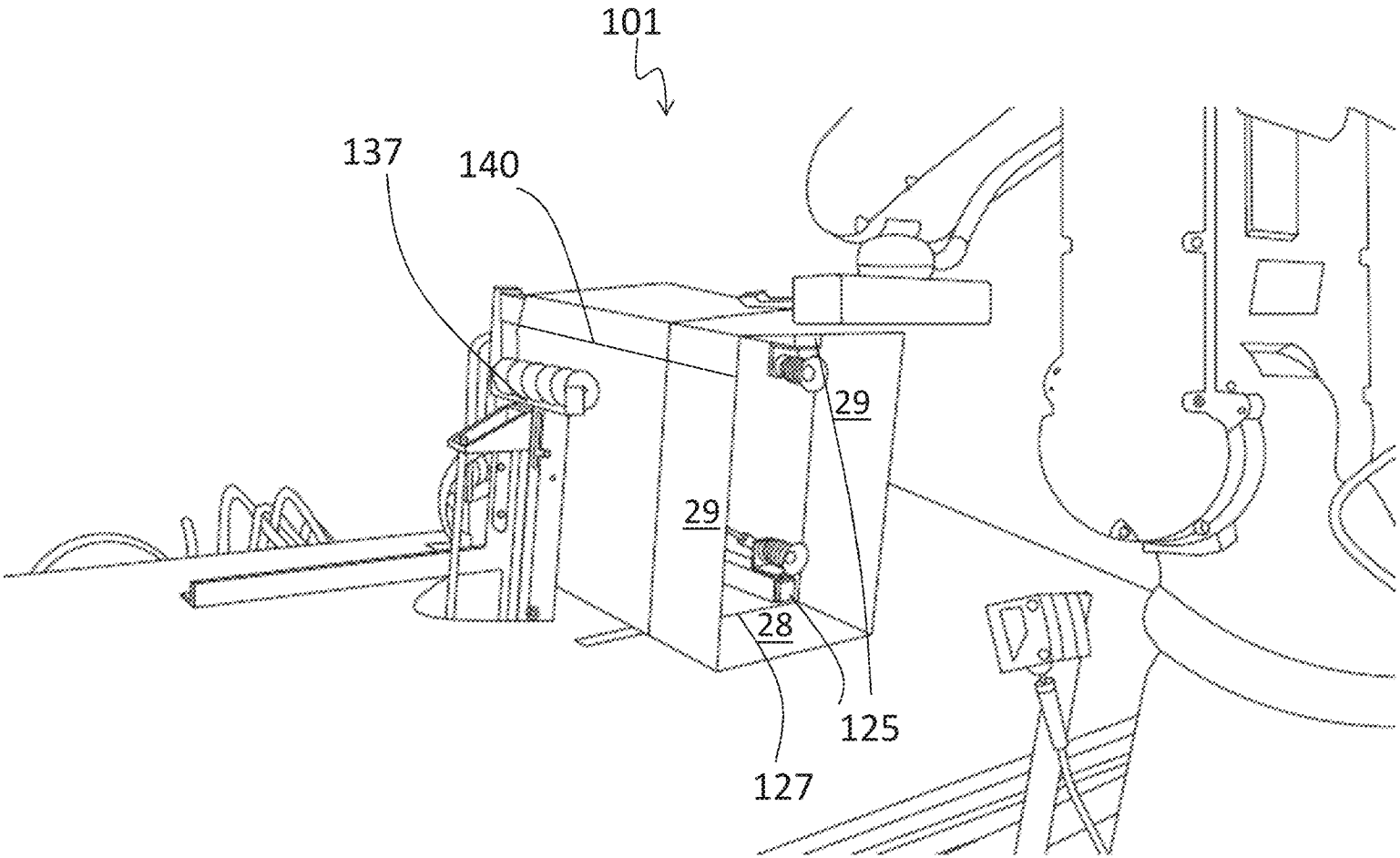
FIG. 10 shows the same box erecting system as shown in FIG. 9 in a position where the box template has been wrapped around the frame.

FIG. 10 shows the same box erecting system 101 as shown in FIG. 9 in a position where the box template 103 has been wrapped around the frame 105. The control system 111 comprises in this embodiment two pushing rods 137 which are controlled to protrude upwards from below the box template in order to wrap the box template around the frame 105. The robot arm 135 can then be controlled such that it folds the top part of the box template (referring to directions in the drawing) around the top part of the stationary frame 105. A manufacturer's joint can thereafter be sealed for example by using the robot arm 135 as sealing device for providing tape or glue. Also, in this embodiment the position of the frame 105 onto the box template 103 is provided such that a distal end 125 of the frame 105 is provided in line with bottom flap creases 127 of the box template 103 such that a bottom can be folded while keeping the frame 105 inside the wrapped box template. Furthermore, also in this embodiment extendable pushing arms 33 can be provided to the frame 105 as described above in relation to the embodiment shown in FIGS. 7*b* and 7*c*. These extendable pushing arms 33 are configured for pushing two second opposing bottom flaps 29, also called major flaps, of the box template 103 outwards from each other at least during an initial part of the folding of two first opposing bottom flaps 28, also called minor flaps, of the box template for forming a bottom of the box. The bottom flaps can in this embodiment of the invention be folded by the robot arm 135. The extendable pushing arms 33 are retracted to a position inside the frame 105 before the major flaps are folded as described above. In this embodiment suction cups 139 are provided to the distal end 125 of the frame 105. These suction cups 139 will keep the minor flaps 28 folded when the robot arm 135 releases the contact with the minor flaps after having folded them towards the frame 105.

After the bottom has been folded the bottom can optionally also be sealed before the box template is separated from the frame 105. Sealing the bottom can be for example providing a tape by the robot arm.

In all the embodiments described above and illustrated in the drawings it is illustrated that the box template is provided in a horizontal direction onto a horizontal surface before wrapping around the frame. However, it is not necessary to provide the box template onto a horizontal surface before the step of wrapping it around the frame. The box template could be provided in any angle possibly onto a surface having any suitable angle. The box template could also be hanging in a vertical direction when the box template is wrapped around the frame. One end of the box template could be attached to something and the box template could be hanging from this attachment point. Possibly the box template could be hanging out from a box template production system. The frame could then be controlled by the control system to wrap the box template around the frame in the same way as described above. Yet another example of alternative orientation of the box template is that the box template can be tilted on its side to any angle during the wrapping around the frame. Furthermore, the box template need not be provided straight or planar during the wrapping procedure around the frame.

According to another aspect of the invention a method for producing boxes from sheet material is provided. The sheet material can be for example cardboard or corrugated board. The method comprises the steps of:

- producing box templates of different sizes from sheet material;
- erecting the box templates according to any one of the embodiments of the methods for erecting boxes as described above.

The method can further comprise an initial step of providing the sheet material to a box template production system from bales of fanfolded sheet material. When the box templates are produced from fanfolded material, such as for example fanfolded corrugated board, folds will be provided in the box templates also at other positions than intended, here called fanfold folds. These fanfold folds can be problematic to handle when erecting the boxes because the box walls may not behave as walls without such fanfold folds. They may fold along a fanfold fold rather than along intended crease lines. Ensuring corner folding in intended positions is crucial to ensure the further process steps, for example bottom flap folding. The use of the frame and the method of wrapping the box templates around the frame for erecting the boxes will be especially suitable for and improve erection processes of box templates comprising fanfold folds, i.e., box templates provided in different sizes on demand from fanfolded sheet material. Such a fanfold fold 140 is shown in the box template 103 which is erected by the box erecting system 101 shown in FIGS. 9 and 10. Here it is apparent that the corner posts 107 of the frame 105 are useful for avoiding folding of the upper part of the box wrongly along the fanfold fold 140 instead of along the correct fold. Hereby the bottom can be closed correctly in a reliable process. The sheet material could also be provided to the box template production system from corrugated rolls. Corrugated board provided in rolls can for example be single phase corrugated board. The use of the frame and the method of wrapping the box templates around the frame for erecting the boxes will be advantageous also when using sheet material provided from such rolls.

According to another aspect of the invention a box production system is provided comprising:

- at least one inlet for receiving sheet material;
- at least one converter part 41 configured for receiving said sheet material and convert said sheet material into box templates of different sizes according to given instructions;
- at least one box erecting system 1; 101 according to any one of the embodiments described above configured for erecting box templates provided from the at least one converter part 41.

In one embodiment of the invention said at least one inlet is configured for receiving said sheet material from bales of fanfolded sheet material as described above. The control system 11; 111 of the box erecting system comprises further a processor and a computer program which when run on the processor causes the control system to perform the method for erecting boxes as described above.

The invention comprises further a computer program comprising computer readable code which, when run on a processor in a control system 11; 111 of a box erecting system according to the invention causes the control system to perform the box erecting method of the invention as described above.

The invention claimed is:

1. A method for erecting boxes from box templates of different sizes, said method comprising the steps of:

adjusting a size of a frame according to a size of a box template which should be erected adjusting the size of the frame comprising adjusting distances between four adjustable corner posts of the frame, each of the four adjustable corner posts being separate and distinct from one another, and distances between each of the four adjustable corner posts and the other corner posts being selectively adjustable;

wrapping the box template to be erected around the frame; and separating the frame from the box template.

2. The method according to claim 1, further comprising a step of sealing a manufacturer's joint of the box template before separating the frame from the box template.

3. The method according to claim 1, further comprising folding a bottom of the box template before separating the frame from the box template.

4. The method according to claim 3, further comprising sealing the bottom before separating the frame from the box template.

5. The method according to claim 1, wherein the step of wrapping comprises:

attaching a box template to be erected to the frame; and controlling the position of the frame by a control system connected to the frame such that the box template is wrapped around the frame.

6. The method according to claim 5, wherein the step of attaching the box template to the frame comprises attaching a first end of the box template to one of four corner posts provided in the frame.

7. The method according to claim 5, wherein controlling of the position of the frame comprises rotating the frame for wrapping the box template around the frame.

8. The method according to claim 7, wherein controlling of the position of the frame further comprises moving the frame laterally.

9. The method according to claim 1, further comprising a step of sealing a manufacturer's joint of the box template before separating the frame from the box template, said step of sealing the manufacturer's joint comprising providing glue to a part of the box template which will be a part of the manufacturer's joint before the box template has been completely wrapped around the frame.

10. The method according to claim 9, wherein the step of sealing the manufacturer's joint further comprises controlling the position of the frame by a control system connected to the frame or controlling the position of a sealing device such that the box template and the sealing device pass each other before the box template is completely wrapped around the frame, said sealing device being connected to and controlled by the control system to eject glue to the box template for sealing the manufacturer's joint when the box template and the sealing device pass each other.

11. The method according to claim 1, wherein the step of adjusting the size of the frame comprises controlling the size of the frame by a control system connected to the frame, wherein said adjusting comprises controlling, by the control system, distances between at least two of the four corner posts in the frame.

12. The method according to claim 1, wherein the step of wrapping the box template around the frame comprises positioning a distant end of the frame in line with bottom flap creases of the box template such that a bottom can be folded while keeping the frame inside the wrapped box template.

13. A method for erecting a box from a box template, said method comprising:

adjusting a size of a frame according to a size of the box template that is to be erected into a box, the frame comprising a plurality of adjustable corner posts defining a size of the frame, each of the plurality of adjustable corner posts having a longitudinal axis, the longitudinal axes of the plurality of adjustable corner posts being generally parallel to one another;

attaching a first end of the box template the frame; and rotating the frame about a rotational axis to wrap the box template around the frame, the rotational axis being generally parallel to the longitudinal axes of the plurality of adjustable corner posts.

14. The method according to claim 13, wherein adjusting the size of the frame comprises adjusting distances between at least two of the plurality of adjustable corner posts of the frame.

15. The method according to claim 14, wherein attaching the first end of the box template to the frame comprises attaching the first end of the box template to one of the plurality of adjustable corner posts of the frame.

16. The method according to claim 13, further comprising folding two first bottom flaps and two second bottom flaps of the box template, the first and second bottom flaps being configured to form a bottom of the box when erected and the two first bottom flaps opposing each other and the two second bottom flaps opposing each other when the box is erected.

17. The method according to claim 16, wherein folding the two first bottom flaps and the two second bottom flaps comprises folding the two first bottom flaps a first amount and folding the two second bottom flaps a second amount that is different than the first amount.

18. The method according to claim 13, further comprising sealing a manufacturer's joint and a bottom of the box and then separating the erected box from the frame.

19. The method according to claim 18, wherein sealing a manufacturer's joint and a bottom of the box comprises providing glue to the first end or a second end of the box template and to the first or the second bottom flaps before the box template has been completely wrapped around the frame and compressing the manufacturer's joint and compressing the first bottom flaps towards the second bottom flaps to seal the bottom.

20. A box erecting system for erecting a box from a box template, the box erecting system comprising:

a frame comprising at least four adjustable corner posts, distances between the adjustable corner posts being adjustable to vary distances therebetween and dimensions of the frame to correspond to dimensions of a box being formed, the at least four adjustable corner posts having generally parallel longitudinal axes, the frame being rotatable about a rotation axis to enable wrapping of a box template therearound to form a box, the rotation axis being generally parallel to the longitudinal axes of the at least four adjustable corner posts;

an attaching device connected to at least one of the at least four adjustable corner posts of the frame and configured for attaching the frame to a box template that is to be erected into a box; and a control system configured to control:

the adjustment of the at least four adjustable corner posts;

the rotation of the frame; and the activation and/or deactivation of the attaching device.

* * * * *